United States Patent [19]

Jenks

[11] 3,993,308

[45] Nov. 23, 1976

[54] LAMINATED FIBERGLASS TENNIS RACKET

[76] Inventor: Herbert R. Jenks, 4600 Numaga Pass, Carson City, Nev. 89701

[22] Filed: Dec. 7, 1973

[21] Appl. No.: 422,510

Related U.S. Application Data

[63] Continuation-in-part of Ser. No. 11,112, May 5, 1970, abandoned, which is a continuation-in-part of Ser. No. 694,458, Jan. 8, 1968, abandoned.

[52] U.S. Cl. ..... 273/73 F; 273/DIG. 7; 264/258; 425/405 R

[51] Int. Cl.[2] ..... A63B 49/10

[58] Field of Search ..... 273/73 R, 73 C, 73 D, 273/73 E, 73 F, 73 G, 67 R, 80 R, DIG. 7; 43/18 GF; 124/23 R; 280/11.13 L

[56] References Cited

UNITED STATES PATENTS

| | | | |
|---|---|---|---|
| 1,054,059 | 2/1913 | Tunmer | 273/73 F |
| 1,122,159 | 12/1914 | Richey | 273/73 G |
| 2,132,780 | 10/1938 | Davis | 273/73 F |
| 2,428,325 | 9/1947 | Collins | 273/73 F UX |
| 2,749,266 | 6/1956 | Eldred | 273/73 F |
| 2,878,020 | 3/1959 | Robinson | 273/73 F |
| 2,980,158 | 4/1961 | Meyer | 273/73 F UX |
| 3,258,795 | 7/1966 | Mailhot | 280/11.13 L X |
| 3,316,337 | 4/1967 | North | 273/73 F X |
| 3,483,055 | 12/1969 | Eshbaugh | 273/73 F X |
| 3,493,240 | 2/1970 | Jenks | 273/73 F UX |
| 3,755,037 | 8/1973 | Erwin et al. | 273/73 F X |
| 3,787,051 | 1/1974 | Johns | 273/73 F |
| 3,930,920 | 1/1976 | Kicherer | 273/73 F X |
| 3,949,988 | 4/1976 | Staufer | 273/73 F |

FOREIGN PATENTS OR APPLICATIONS

| | | | |
|---|---|---|---|
| 541,831 | 10/1955 | Belgium | 273/73 F |
| 848,826 | 8/1970 | Canada | 273/73 F |
| 2,033,630 | 11/1970 | France | 273/73 F |
| 1,942,082 | 4/1971 | Germany | 273/73 F |
| 2,130,663 | 2/1972 | Germany | 273/73 F |
| 1,122,895 | 8/1968 | United Kingdom | 273/73 F |

*Primary Examiner*—Richard J. Apley
*Attorney, Agent, or Firm*—Lyon & Lyon

[57] ABSTRACT

A one-piece molded tennis racket or similar article constructed of resin-impregnated fabric consisting essentially of a plurality of substantially continuous fibers some of which extend from the butt of the handle, around the head frame and back down the handle, and other continuous fibers which extend just around the head frame. In one embodiment of the invention, the unique laminating technique provides a hollow tubular handle. In another embodiment of the invention, a flat handle is formed consisting of a pair of hollow-rectangular channels. The principal advantage of the racket in its finished form is that it has a high-strength-to-weight ratio.

5 Claims, 38 Drawing Figures

FIG. 1.
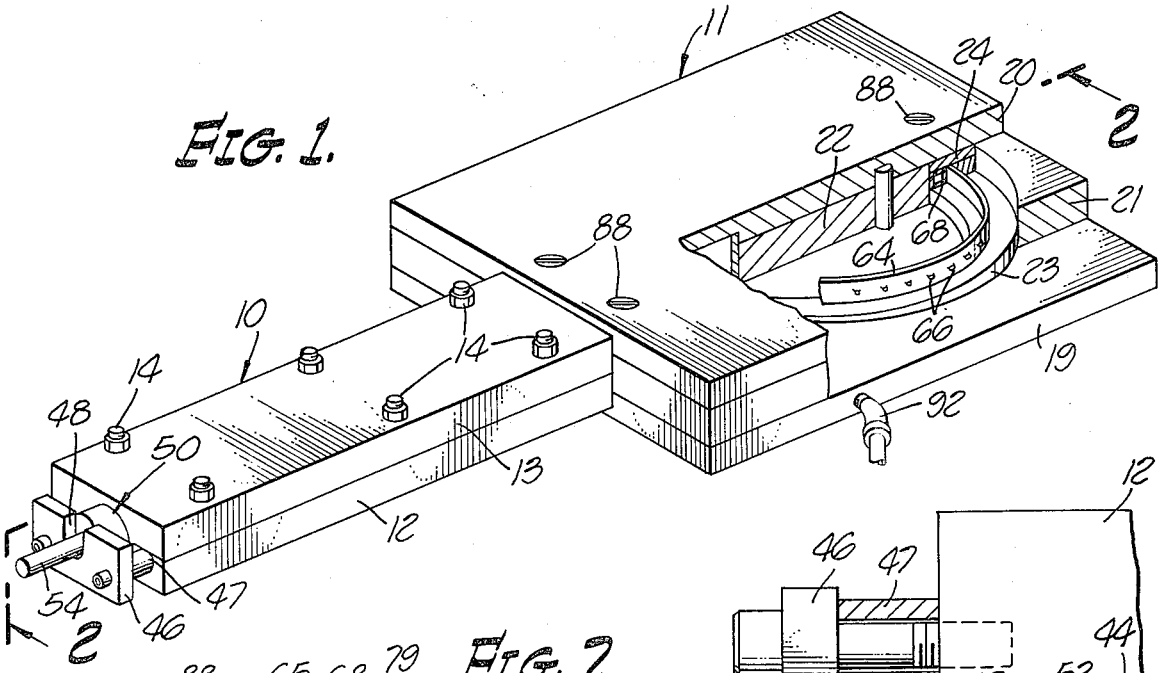
FIG. 7.
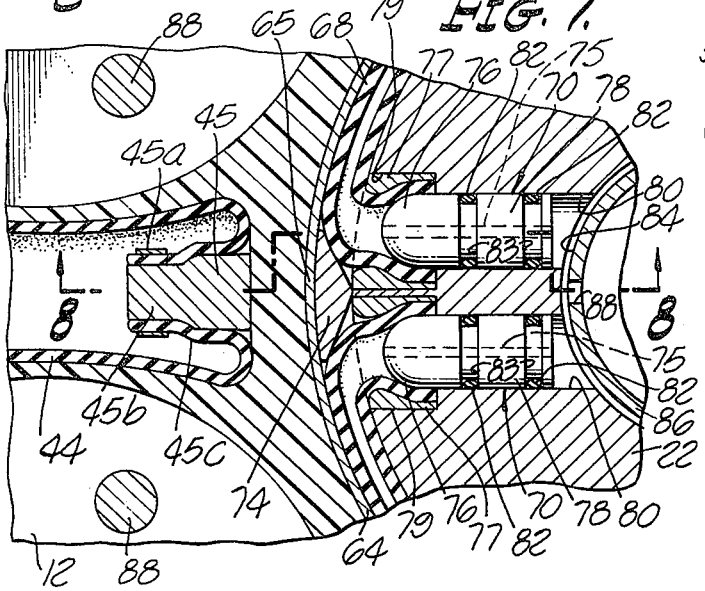
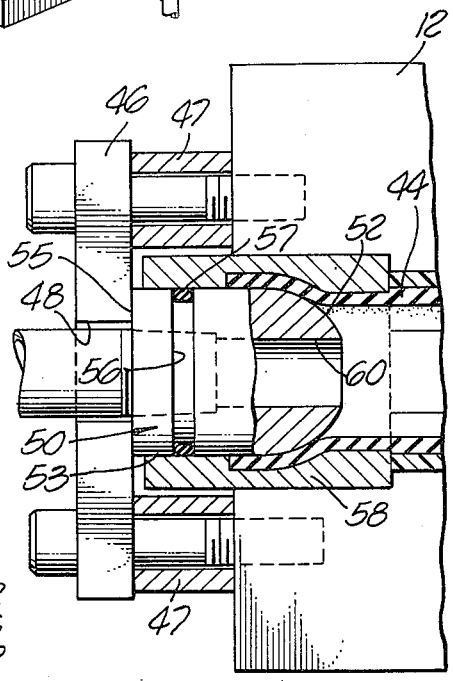
FIG. 6.
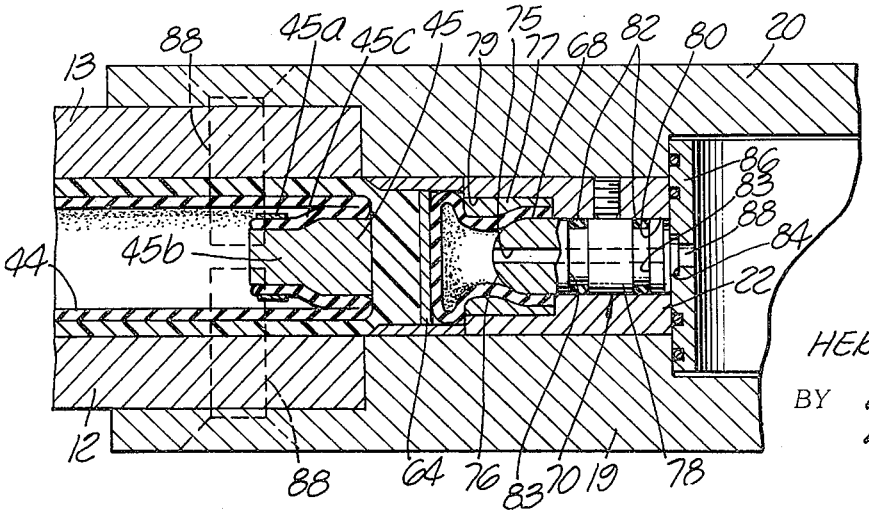
FIG. 8.
INVENTOR
HERBERT R. JENKS
BY Lyon & Lyon
ATTORNEYS INVENTOR
HERBERT R. JENKS
BY
Lyon & Lyon
ATTORNEYS INVENTOR,
HERBERT R. JENKS
BY
Lyon & Lyon
ATTORNEYS INVENTOR
HERBERT R. JENKS
BY
Lyon & Lyon
ATTORNEYS INVENTOR
HERBERT R. JENKS
BY Lyon & Lyon
ATTORNEYS

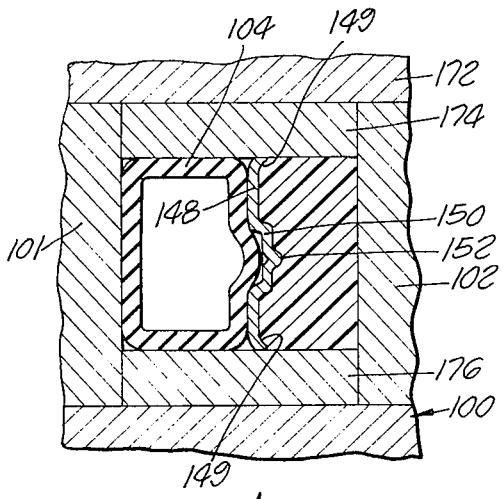
FIG. 13.
FIG. 14.
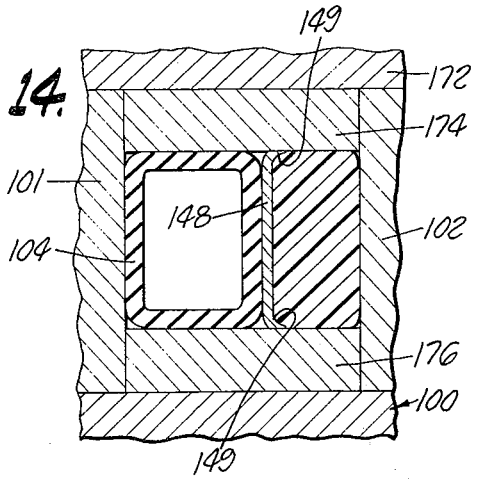
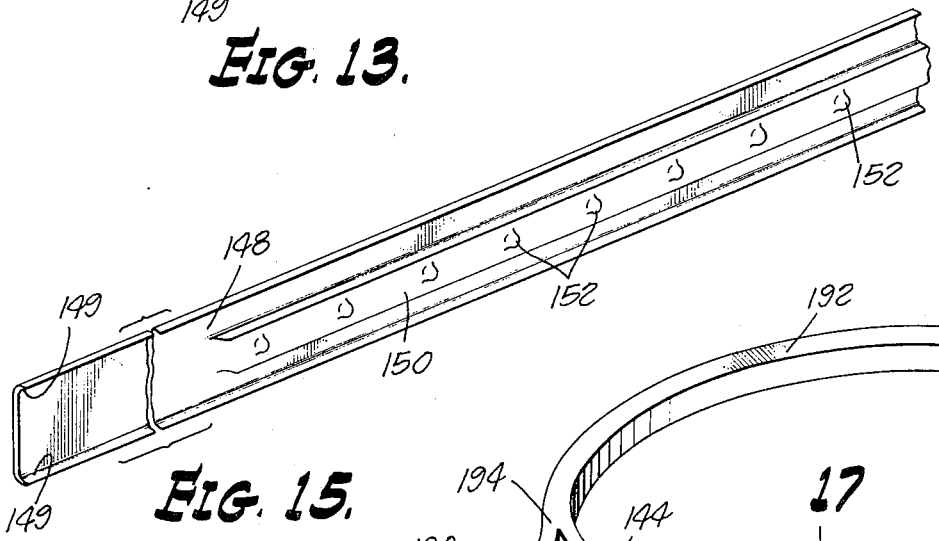
FIG. 15.
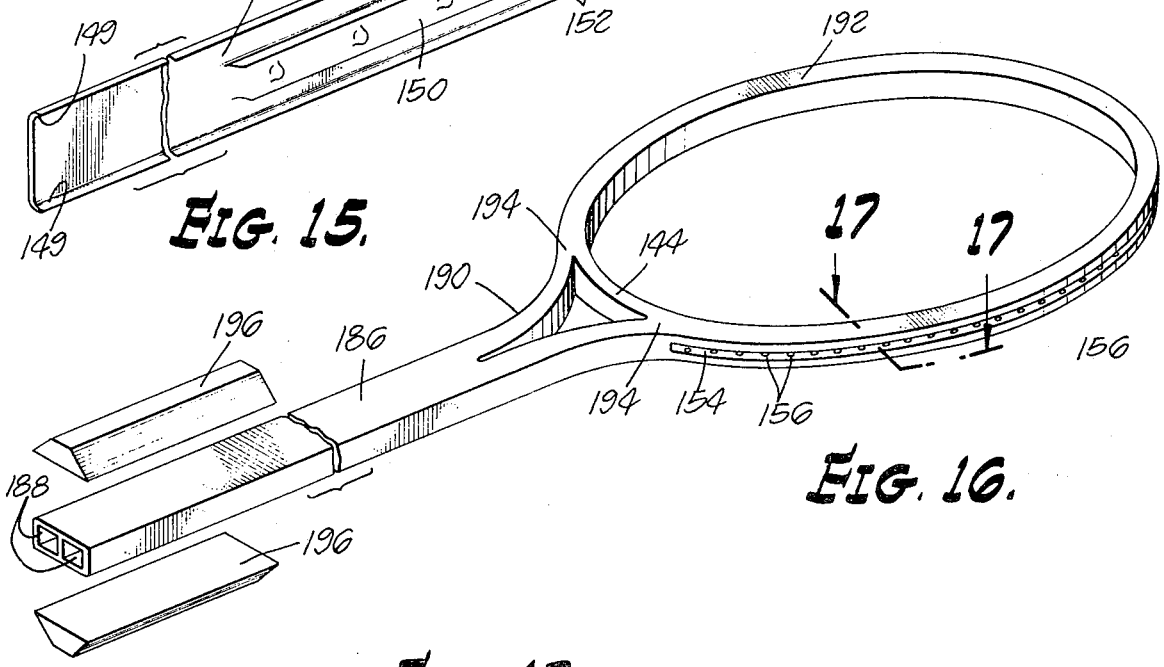
FIG. 16.
FIG. 17.
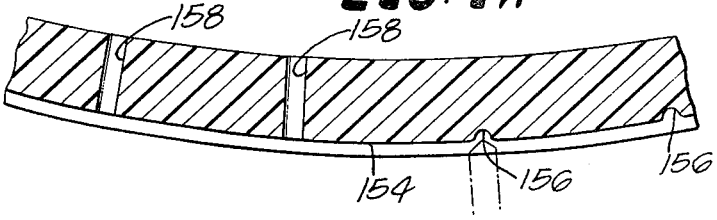
INVENTOR.
HERBERT R. JENKS
BY Lyon & Lyon
ATTORNEYS

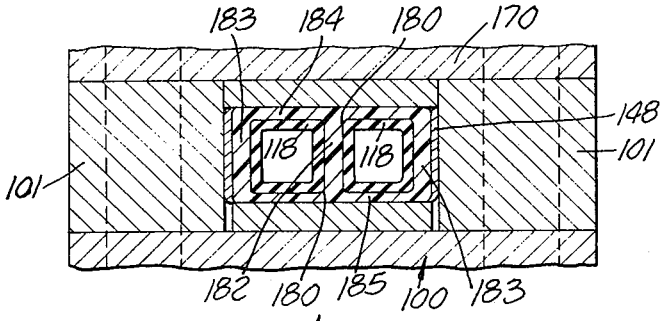
FIG. 18.
FIG. 20.
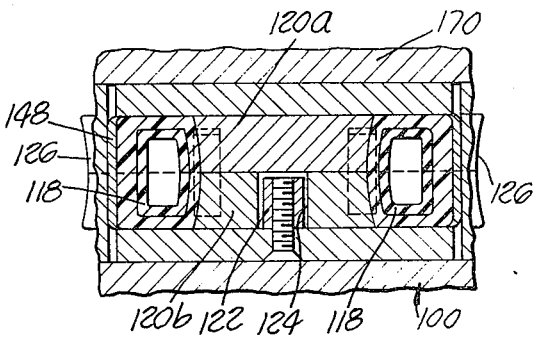
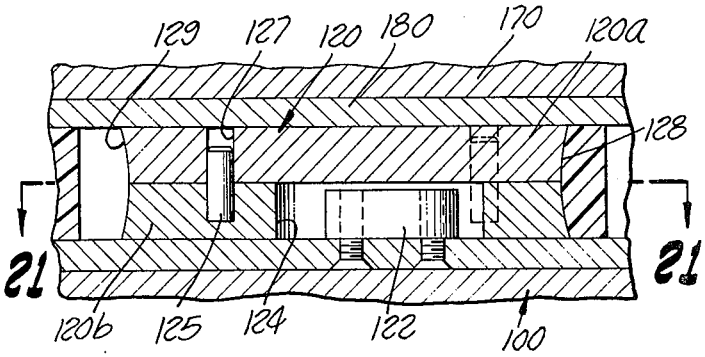
FIG. 19.
FIG. 21.
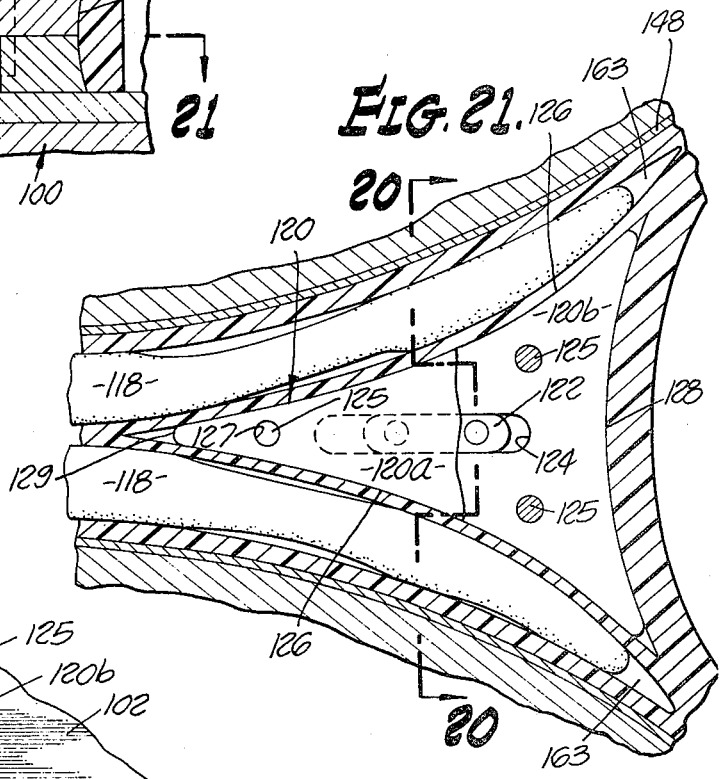
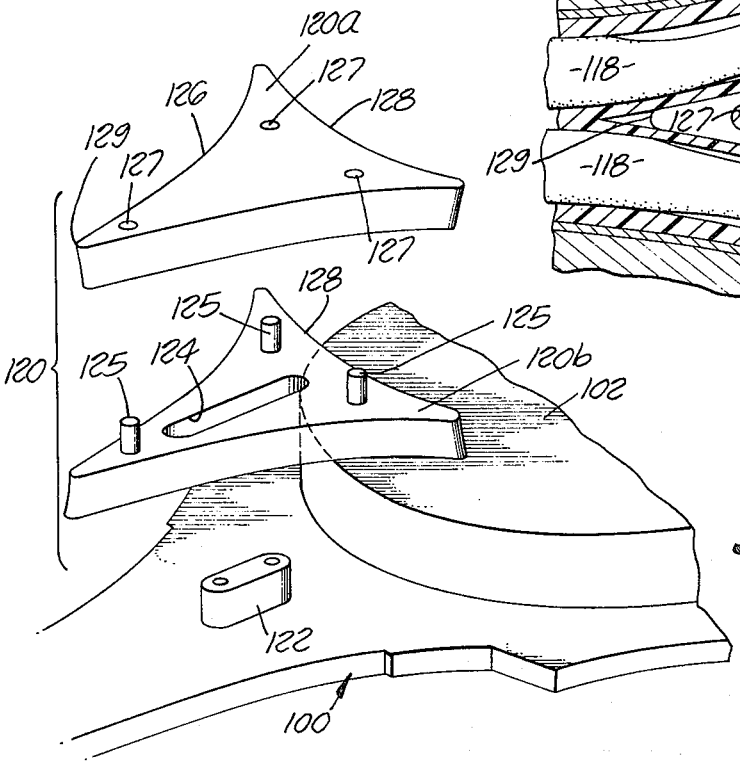
FIG. 22.
INVENTOR.
HERBERT R. JENKS
BY Lyon & Lyon
ATTORNEYS

LAMINATED FIBERGLASS TENNIS RACKET

BACKGROUND OF THE INVENTION

This is a continuation-in-part of my patent application filed May 5, 1970, bearing Ser. No. 11,112 (now abandoned) which was in turn a continuation-in-part of my application filed Jan. 8, 1968, Ser. No. 696,458 now abandoned. For many years tennis rackets have been constructed of wood and various techniques have evolved through the years for forming the wood in such a manner as to provide a racket having the desired shape and proper performance characteristics. Presently, wooden tennis rackets are made of laminated wood since this is the easiest way to form the various curves yet maintain the desired qualities of strength, weight and resilience. A major difficulty with wooden tennis rackets is that the wood looses its resilience if it becomes too dry or too moist and it is customary to keep wooden rackets in a press to assure that if they should absorb some moisture, they will not warp when they dry out. A further difficulty with wooden rackets is the fact that they are somewhat fragile and the head and the throat can easily be broken if subjected to more then just normal usage. While a laminated wood tennis racket can be constructed having generally good strength and resilience for forces imparted normal to the axis of the handle, a racket of this type has generally low torque characteristics. Unless the ball strikes the racket near the center of the strings, maximum force will not be imparted to the ball because the head will tend to twist about the axis of the handle. In fact, if the ball is struck near the edge of the stringed portion the player will generally feel a rather dull and lifeless response quite unlike that experienced when the ball is struck in the center of the strings. Such a response indicates the inability of the wooden racket to withstand abnormal forces, particularly torque, or to provide the same degree of resilience at all portions of the head and it is presently necessary for the player to concentrate on striking the ball with the center of the racket.

Attempts have been made in the past to construct a tennis racket of materials other than wood but most of such efforts have been unsuccessful. Recently, alloys have been developed which permit the manufacture of a light weight metal tennis racket, but such alloys require special treatment in many cases and the cost is generally quite high. Metal rackets currently offered for sale are not only more expensive than wood but are generally too flexible particularly in regard to torque. There have also been efforts to manufacture fiberglass tennis rackets but the general approach has been to rely upon the techniques formerly used in the construction of wooden tennis rackets and then to use the fiberglass only as an outer covering. In other words, the racket is a composite of wood, resin and fiberglass or sometimes metal and fiberglass. With such construction, the fiberglass is not a structural element of the racket but is only a covering to prevent the entry of moisture and to provide a decorative surface. The strength and resilience of the racket is still dependent upon the core material used and in the case of wood, the lamination techniques employed.

SUMMARY OF THE INVENTION

The present invention solves the above-mentioned difficulties encountered with rackets of previous design while offering a racket with improved performance characteristics. With the exception of the leather grip covering and the stringing, the finished racket of the present design is of one piece, composed entirely of resin-impregnated fiberglass material molded in such a manner that the handle is hollow and the fibers of material forming the handle are blended smoothly into the throat and around the head. By skillfully placing strips of fiberglass material in such a manner as to form the handle and the relatively flat head, the desired strength and resilience are obtained and the unexpected advantage of increased torque characteristics is also obtained. The fiberglass strips are a unidirectional weave, having substantially all of the fibers extending lengthwise therein so that the finished racket will have all of the fibers lying in a plane normal to the direction of impact of the ball, thus affording maximum strength and resilience. Being constructed entirely of fiberglass, the presence of moisture or extreme dryness no longer matter as they do for wooden rackets, except of course as such conditions may effect the type of stringing used. In addition, the material employed in making the racket is of much lower cost than any metal components heretofore used, and easier to work with. Although this description refers to the use of glass fiber material, it is equally contemplated that any pre-impregnated fabric may be used such as those using boron or quartz fibers.

The present invention also solves the manufacturing difficulties present in previous rackets by providing a fast and convenient process for molding the rackets into one homogeneous structure. It is the manner in which the fibers in the various strips are oriented, together with the application of heat and internal pressure which form the basic features of the unique process herein.

It is an object therefore of the present invention to provide a one-piece tennis racket constructed entirely of resin-impregnated fiberglass material.

It is a further object of the present invention to provide a laminated fiberglass tennis racket in which substantially all of the glass fibers are oriented in substantially the same plane, and such plane is parallel to the hitting plane.

It is also an object of the present invention to provide an improved process for manufacturing a tennis racket.

More specifically, it is an object of the present invention to provide a process for making a tennis racket by laminating a plurality of resin-impregnated fiberglass sheets and curing the resin with heat and internal pressure.

It is a specific object of the present invention to provide a process for molding a fiberglass tennis racket by employing internal pressure in order to apply tension to the glass fibers so that they are all oriented substantially in the same direction.

It is another object of the invention to provide a unique apparatus employed in carrying out the process, including the mold as well as internal pressure applying devices.

DESCRIPTION OF THE DRAWINGS

FIG. 1 is a perspective view of the mold, partially in section showing some of the details of the mold used to construct the first embodiment.

FIG. 6 is a sectional plan view taken along line 6—6 of FIG. 2 showing some details of the internal pressure means.

FIG. 7 is a sectional view taken along line 7—7 of FIG. 2 showing the details of the pressure system used in one embodiment for the head portion of the racket.

FIG. 8 is a sectional elevation taken along line 8—8 of FIG. 7 relating to the means of closing the other end of the pressure means.

FIGS. 12–30 relate to features of a second embodiment of the invention.

FIG. 12 is a partial sectional plan view of the molding apparatus for the second embodiment showing a racket therein partially in section.

FIG. 13 is a sectional elevation taken along line 13–13 of FIG. 12.

FIG. 14 is a sectional elevation taken along line 14—14 of FIG. 12.

FIG. 15 is a partial perspective view showing a portion of the detent shim.

FIG. 16 is a perspective view of the second embodiment of the invention providing a racket blank.

FIG. 17 is a sectional view taken along line 17—17 of FIG. 16.

FIG. 18 is a sectional elevation taken along line 18—18 of FIG. 12.

FIG. 19 is a sectional elevation taken along line 19—19 of FIG. 12 showing a detail of the throat block.

FIG. 20 is a sectional elevation taken along line 20—20 of FIG. 21.

FIG. 21 is a sectional plan view taken along line 21—21 of FIG. 19.

FIG. 22 is an exploded perspective view showing a portion of the mold directed to the formation of the throat of the racket.

FIG. 23 is a perspective diagrammatic view showing the disposition of the various laminating strips used to form the second embodiment of the invention.

FIGS. 24, 25, 26, 27, and 28 are diagrammatic perspective views showing various stages of the laminating procedure.

FIG. 29 is an enlarged sectional elevation of a portion of the head frame showing the manner in which the detent shim forms the string groove and stretches the fibers surrounding the head frame.

FIG. 30 is an enlarged sectional elevation showing the disposition of the various laminae in the handle portion of the racket before and after curing.

FIG. 31 is a plan view of a portion of a racket formed having a hollow cavity which is continuous from handle to headframe.

FIGS. 32, 33, and 34 are cross-sectional diagrammatic views taken at line A—A of FIG. 31 demonstrating the various stages in lay up of the headframe.

FIG. 35 is an enlarged partial sectional view of the throat of this racket.

DESCRIPTION OF THE FIRST EMBODIMENT

Figures 2, 3, 4, 5:
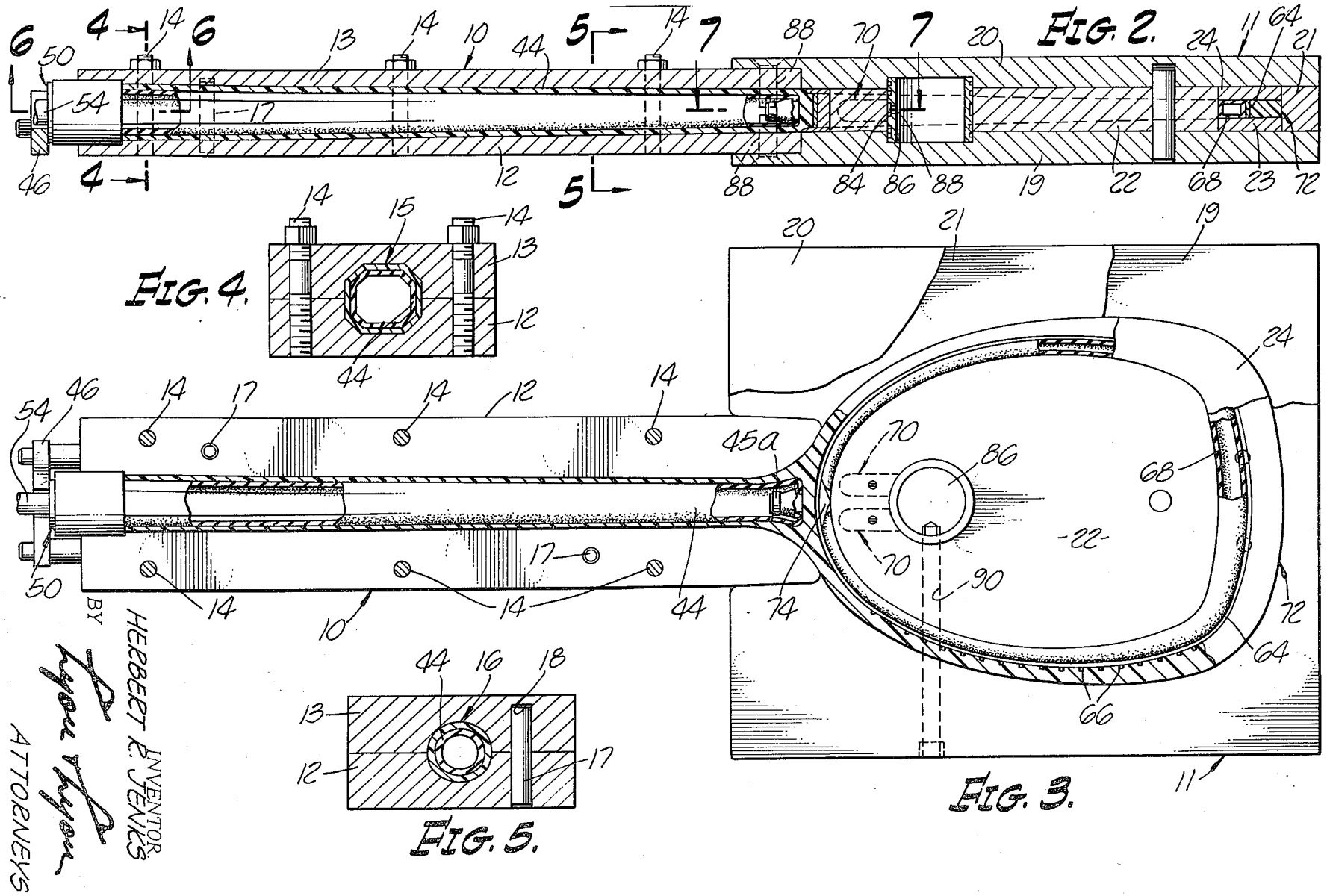
FIG. 2 is a sectional side elevation taken along line 2 of FIG. 1.
FIG. 3 is a plan view partially in section of the mold showing the relationship of the components thereof to the first embodiment of the racket shown therein.
FIG. 4 is a sectional end view taken along line 4—4 of FIG. 2.
FIG. 5 is a sectional elevation taken along line 5—5 of FIG. 2.

Referring now to FIGS. 1–5, the general configuration of the mold is shown providing an interior cavity having the desired configurations of the finished racket. In FIG. 1, the mold comprises a handle portion 10 and a head portion 11. The handle portion 10 comprises a bottom half 12 and a top half 13 which are to be secured together by appropriate fastening means 14 during the molding operation. The interiors of the mold halves 12 and 13 are hollowed out to form the exterior dimensions of the handle. As shown in FIG. 4, the semi-octagonal configuration 15 for the grip portion of the handle is provided in the interior of the upper and lower halves 12 and 13 further up the handle midway between the grip and the throat at which point the configuration is substantially cylindrical as shown at 16. Guide pins 17 are mounted in the lower half 12 and extend upward into apertures 18 in the top half 13 so as to assure that the halves of the handle portion of the mold are properly aligned when they are assembled.

The head portion 11 of the mold consists of a bottom plate 19 and a top plate 20. The top and bottom plates 20 and 19 are substantially flat rectangular pieces and interposed between them is a center section which forms the head of the racket. Conforming to the outer dimensions of the racket head is the outer center plate 21 and providing the inner dimensions for the racket head is the inner center plate 22. The configurations of these plates can best be seen in FIG. 3. Since it is desired that the racket head be tapered dimensionally as viewed from the side thereof, a ramp type shim 23 is secured on the inner surface of the bottom plate 10 and a similar shim 24 is secured to the inner surface of the top plate 20. Although FIGS. 1 and 2 show a continuous taper for the shims 23 and 24, it is understood that any degree of taper may be formed as desired for the greatest strength and resilience in the head of the racket. The remaining structural features of the mold relate primarily to the internal pressure means and a more detailed explanation of those features will be supplied subsequently in conjunction with the explanation of the internal pressure means and its operation. It is sufficient if, at this point, it is understood that the mold provides internal cavities having the general desired configuration of the finished tennis racket so that the various laminations may be laid therein during the laminating steps. With the mold tops 13 and 20 removed, the mold is open so that the laminae may be inserted therein.

Figure 11:
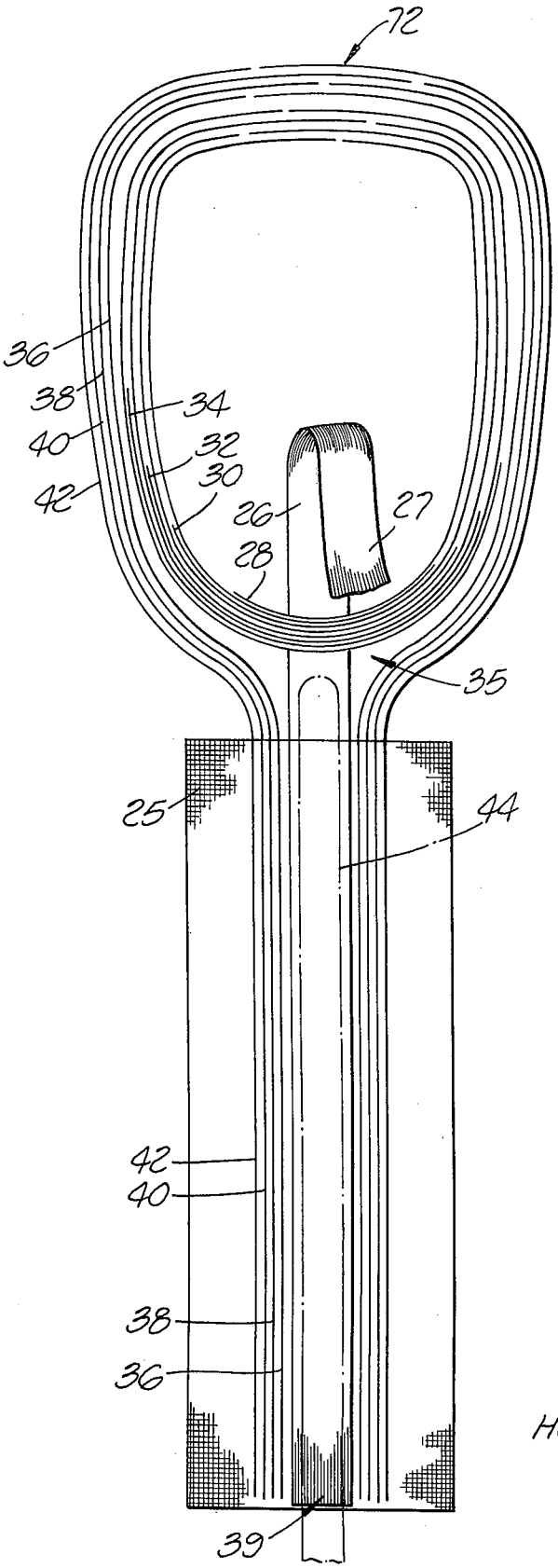
FIG. 11 is a diagrammatic plan view demonstrating the initial disposition of the laminae in the first embodiment of the racket.

Referring now to FIG. 11, the various laminae are shown in diagrammatic form in the positions they are first placed in the mold. All of these sheets are a woven cloth material consisting of glass fibers wherein the sheets have been previously impregnated with a thermo-setting resin such as epoxy or phenolic. The resin impregnated sheets can thus be handled in their dry state, and are then cut into the strips shown herein.

Some strips are made from cloth having a bi-directional weave, which has an approximately equal number of fibers in both the warp and woof. Other strips are made from cloth having a uni-directional weave in which substantially all of the fibers run in one direction with just enough cross fibers to hold the others together. Strips made from the uni-directional cloth have the majority of the fibers extending along their length.

The first layer of material is an outer covering 25 having a bi-directional weave. This outer covering has a generally rectangular shape and extends substantially the entire length of the handle portion 10 of the mold. The width of covering sheet 25 is just sufficient so that after all the other laminae are placed in the mold, the sheet 25 is wrapped around and overlapped slightly providing a uniform covering. The next laminae to be inserted in the mold is rectangular handle strip 26 which extends from the butt 39 of the handle upwardly past the throat and into the opening of the frame which forms the head of the racket. The handle strip 26 is of a length sufficient to transverse the length of the handle up into the frame and back down again on the other side of the handle to the butt 39 once more. The handle strip 26 is a glass fiber material of a uni-directional weave. The free end 27 of strip 26 is left inside the frame portion of the head while the remainder of the laminae are laid into the mold whereupon the end 27 will be extended downwardly on top of the other laminae to the butt 39 of the handle.

The remainder of the various laminae are next inserted into the mold and the order of their insertion is not particularly important if it is insured that the proper placement and arrangement of these laminae has been made. In the head or frame portion of the racket, there are a plurality of inner wraps, preferably four in number. In FIG. 11, these inner wraps are designated 28, 30, 32, and 34. Each of these inner wraps 28 to 34 consist of two plys each of glass fiber material, having a uni-directional weave. Inner wraps 28 are of the shortest longitudinal dimension and in the throat portion generally designated 35, which comprises that portion of the racket where the head joins the handle, the inner wraps 28 are overlapped to provide an excess of material for the throat section 35. Each of the further inner wraps 30, 32 and 34 are progressively of greater longitudinal dimension so that the overlap in the throat section 35 is greater and so that greatest dimensional thickness is provided in that area where all four of the inner wraps overlap. The dimensional thickness will decrease outwardly up to where the inner wrap 34 terminates.

Next, surrounding the inner wraps 28 to 34 are the outer wraps 36 and 38 each of which consists of two plys of glass fiber material of longitudinal uni-directional weave, extending from the butt end of the handle 39 upwardly along the handle around the head and back down to the butt end of the handle again. Immediately adjacent the outer wraps 36 and 38 are two additional outer wraps 40 and 42 which also extend from the butt portion 39 of the handle around the head and back down to the handle again but outer wraps 40 and 42 consist of four plys each.

Figure 10A:
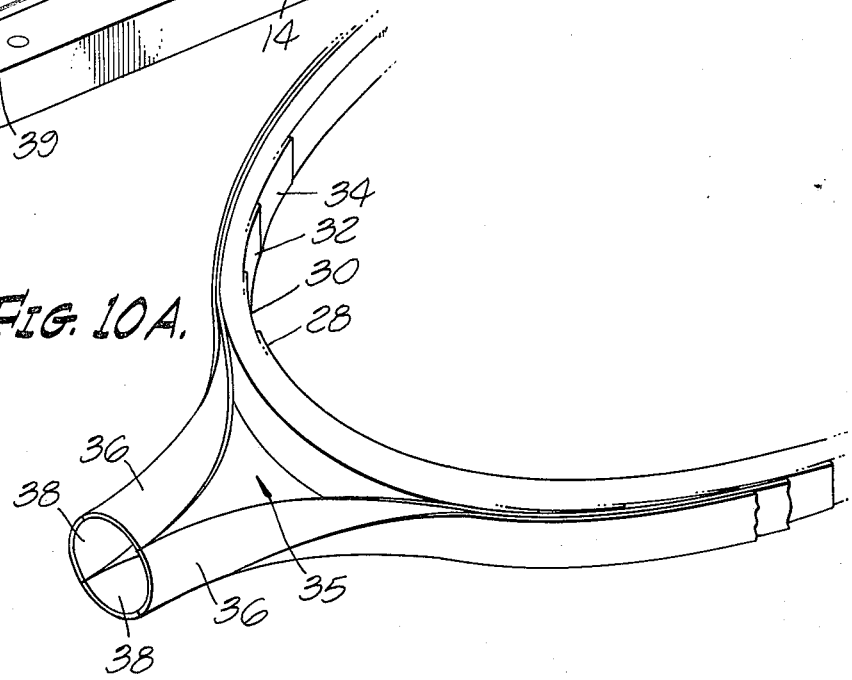
FIG. 10*a* and 10*b* are diagrammatic perspective views illustrating the disposition of the laminae for the first embodiment of the racket.
Figure 10B:
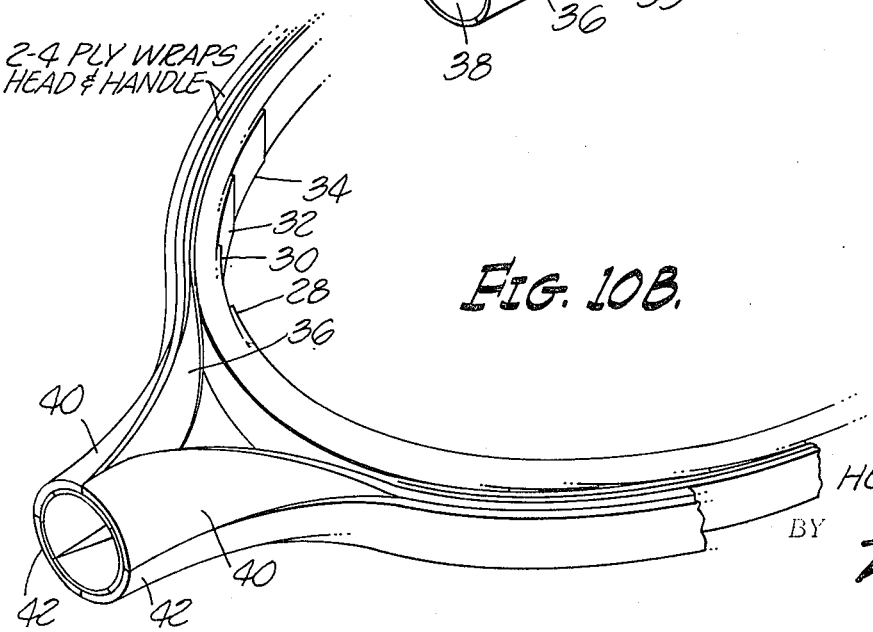

The transition from the relatively planar configuration of the head of the racket into the cylindrical configuration of the handle of the racket is made in the throat area 35 by forming the outer wraps 36, 38, 40 and 42 in such a manner as to flow smoothly from one configuration to the other. As will be seen by reference to FIG. 10(*a*), the first set of outer wraps 36 and 38 are brought down from the head portion of the racket into a cylindrical configuration by separating them as they come down from the head and positioning them in each of the four quadrants as shown in FIG. 10(*a*). The left hand portion, for example, of outer wrap 36 will be stationed along the top portion of the handle and the corresponding part of outer wrap 38 coming around from the other side of the head will be positioned along the bottom of the mold with the remaining two ends of wraps 36 and 38 positioned along each side of the mold. The cylindrical configuration of the handle will be provided by the interior pressure molding means which will be more fully described subsequently, however, it is sufficient at this point to state that as soon as the various outer wraps are stationed along the bottom and sides of the mold, the interior pressure means will be inserted whereupon the remainder of the wraps which are to be stationed along the top portion of the mold will be arranged as herein described. Reference now being made to FIG. 10(*b*), the outer wraps 40 and 42 are arranged in a manner similar to that for wraps 36 and 38 so that the various elements thereof are distributed equally about the circumferential surface of the handle.

Although FIG. 11 diagrammatically illustrates the placement of the inner wraps 38 to 34 one inside the other so that only the inside end of the inner wrap 38 is exposed to the interior of the racket head, it is equally possible to stagger all of the ends of the wraps 28 and 34 in the manner shown in FIG. 10(*a*), and equal results are contemplated.

The pressure means for the handle is shown in phantom lines in FIG. 11 and is designated 44. This pressure means is also shown in FIGS. 3, 7 and 8 as comprising a longitudinal cylindrical bag having a plug or closure means 45 sealing the end thereof. The plug 34 includes a band 45(*a*) which encircles the small end 45(*b*) of the plug. The shoulder 45(*c*) is radiused so that air pressure in the bag seals the bag at that point. This pressure bag 44 is composed of an elastomeric material which will expand the various laminae thereof outwardly to conform to the dimensions of the mold. After pressure bag 44 has been laid into the appropriately assembled laminae, and the outer wraps have been positioned as previously described, then the end of the handle strip 26 is moved downwardly towards the butt end 39 of the racket and then the outer surface covering sheet 25 is encircled about the length of the handle holding all of the various laminae in the desired position whereupon the handle mold cover 13 is secured in place by the appropriate fasteners 14.

As shown in FIG. 1 there is an open ended bracket device 46 spaced from the end of the lower portion of the mold 12 by standoffs 47 and having a notch 48 therein, the top of which is open. As best demonstrated in FIG. 6, the purpose of the bracket 46 is to receive and to retain in position the pressure bag connector 50. The connector 50 comprises a hemispherical end 52 which becomes cylindrical near the rear portion thereof and is connected to a pressure conduit 54. The pressure conduit 54 is adapted to be received in the notch 48 and the rearward surface 55 of the cylindrical portion abuts against the bracket 46 to retain it in this position. The provision for the open side of notch 48 permits the easy insertion and removal of the pressure bag connector 50 in the mold. The cylindrical portion 53 of the connector is provided with an annular groove 56 in which there is situated an O-ring 57 and the connector is surrounded by a connector sleeve 58 against the interior surface of which the O-ring 57 seals. The inner surface of the connector sleeve 58 receives the end of the pressure bag 44 and retains it between the inner surface thereof and the outer surface of the hemispherical end 52 of the connector. Air or steam under pressure is emitted through the connector 52 entering the pressure bag 54 through passage 60 in the connector. Once the bag is pressurized, the connector retains the bag between the curved portions of the end 52 and the sleeve portion 58 thereof and the connector is held in the bracket 46 as previously described. The extreme end 45 of the pressure means 44 will also expand under the pressure applied and will force the various laminae thereof upwardly towards the head of the racket.

The completion of the head portion of the mold is next. In the interior of the head of the racket, inside the inner wraps 28 to 34 and around the exterior of the inner center plate 22, there is first positioned a metal shim 64 which is continuous about the inner surface of the racket head and which is provided with a plurality of short pins or stubs 66 (see FIG. 3) which project outwardly and into the inner wraps. The purpose of the pins 66 is to provide indentations in the final molded product at desired positions to locate holes to be drilled through the frame for stringing the racket. It is not the purpose of the pins 66 to extend entirely through the frame but only to locate the holes and to start them. Next between the shim 64 and the inner center plate 22 there is situated a second pressure means or bag 68. As shown in FIGS. 3 and 7, the pressure means 68 is a closed tube having both ends located near the throat portion 35 where they are maintained in locked positions by connectors 70. The pressure means 68 again comprises an elastomeric, expandable body of somewhat tubular configuration which extends around the inside of the head portion of the mold, the purpose being that when pressurized, it will cause the various laminar portions of the fiberglass material to expand outwardly to assume the outer configuration of the mold.

It will be appreciated, that it will also be the function of the pressure means 68 to expand or stretch the longitudinally oriented fibers of the various laminae 28–42 and this is an important feature of this invention. It is of particular advantage in this invention that the longitudinally oriented fibers of the racket are substantially aligned and in order to align those fibers without having any kinks or wrinkles therein which would substantially weaken the structure or cause warping or non-uniform resilience characteristics, it is necessary to place the fibers of the inner and outer wraps under some degree of tension. Since it is not possible to stretch the fibers sufficiently from their tightly positioned configurations around the inner center plate 22 as previously described, it is found that by cutting various of the individual plies of the inner and outer wraps at various staggered locations along the extreme upper bow 72 of the head the proper amount of tensioning of the fibers can be accomplished. As shown in FIG. 11, diagrammatically, the various wraps are cut at staggered locations in the bow section 72. Although it would appear from FIG. 11 that all of the plies of each of the wraps is cut at the same location, this is not necessarily the case as the individual plies in each wrap may be cut in a staggered fashion the same as the wraps themselves are cut in staggered fashion. Since the actual expansion provided by the pressure means 68 will be taking place after heat has been applied to the resin in the mold, the various laminae will adhere to one another and expansion of the pressure means 68 will place the fibers under tension but will not need to overcome the resistance of those fibers to longitudinal extension since they will be allowed to slide somewhat with respect to one another during this expansion process.

There is left one area in the mold where expansive forces are not supplied directly by the pressure means 68 and that is in the throat where the two ends of the pressure means 68 join the connector 70. In order to supply the necessary outer pressure at that point, a small fillet 74 is inserted between the inner center section 22 and the shim 64. Air or steam under pressure is emitted into the pressure means 68 through the passages 75 in the connectors 70. The connectors 70 have a hemispherical outer end 76 and a cylindrical body portion 78. Radiused collars 77 situated in cavities 79 cooperate with the curved ends 76 to retain the ends of the pressure means 68. These connectors 70 are positioned in passages 80 formed in the body of the inner center section 22 and pressure is retained therein by the O-rings 82 situated in the grooves 83. The passages 80 communicate, as shown in FIG. 8 with an annular groove 84 formed in the outer peripheral surface of a spool 86 which then has a radial passage 88 communicating the annular groove 84 with the hollow interior portion of the spool 86 which then has a radial passage 88 communicating the annular groove 84 with the hollow interior portion of the spool 86. The air passage is completed by the lateral passage 90 extending through the bottom plate 19 which communicates with the interior of the cavity provided by the spool 85 and has a convenient fitting 92 for the attachment of a source of pressurized air or steam.

It will be noted, particularly from viewing FIGS. 10(*a*) and 10(*b*) that the fiberglass strips 28 through 42 have a substantially rectangular configuration or in other words are initially of uniform width throughout their length. It would also be noted as shown in FIG. 2 that the width of the head of the racket tapers from the throat section 35 to the bow 72. Although a uniform taper from the throat to the bow is shown in FIG. 2, it is equally contemplated that a taper may exist only part way from the throat leaving the end frame of somewhat greater width. The point here is that this decrease of the width dimension of the laminae is accomplished during the molding process without bunching up or wrinkling the various plies of the laminae since each ply is practically nothing more than a bundle of glass fibers all extending around the head of the racket and there are practically no lateral fibers. When the resin becomes soft, the fibers in the end frame become easily mobile and will move to assume a new orientation. In the embodiment shown in FIG. 2, the cross section of the frame 72 has its major and minor axes transposed from that of the cross section taken through the center line at the throat portion 35.

Figure 9:
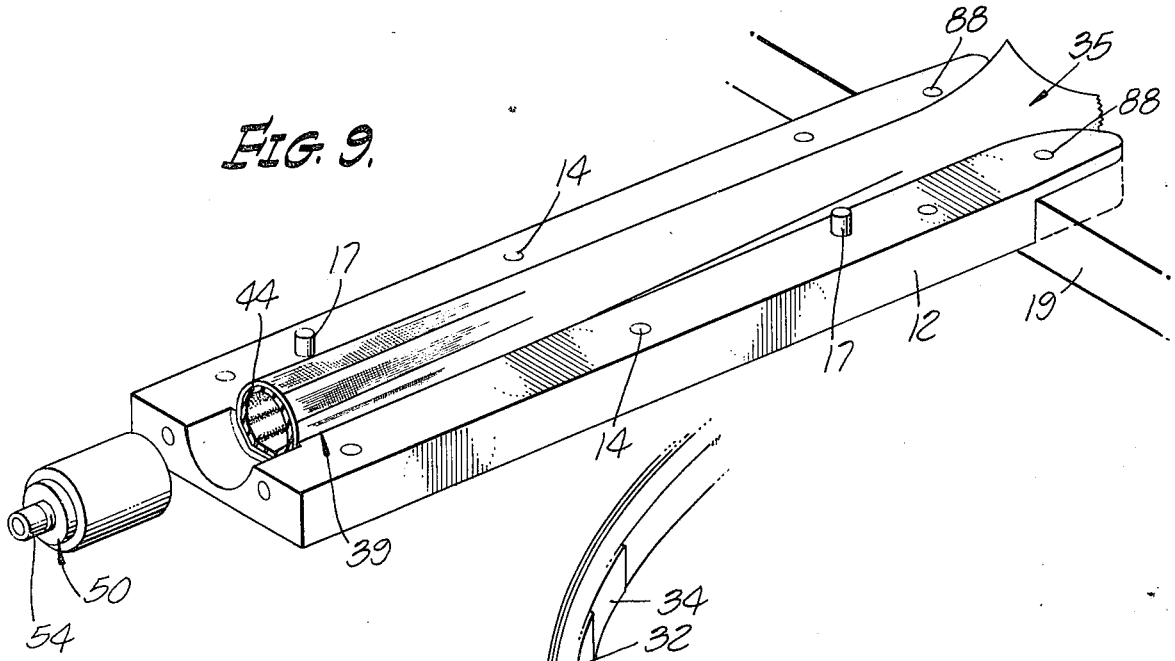
FIG. 9 is a partial perspective view illustrating the disposition of the hollow cylindrical molded handle portion of the first embodiment of the racket.

After the laminae are in position as previously described and the pressure bag and the shim 64 are in place in the head frame portion 11, the top plate 20 is secured in place by appropriate fastening means such as screws 88. The rear screws 88, there being two on the top and two on the bottom, secure the two portions 10 and 11 of the mold together and in fact the handle portion 10 may extend part way into the head portion 11 as shown in FIGS. 3, 8 and 9. The entire mold is then placed in an oven or between heated platens in order to raise the temperature to a point within the range of 275° to 350° F. whereupon the resin will become soft and the fibers mobile. The fittings or conduits 54 and 92 are connected to a source of air pressure and when the resin has cured to the state where it becomes tacky or sticky, which is on the order of about five to seven minutes, air under pressure is supplied to the pressure bags 44 and 68 causing them to expand outwardly in an obvious manner as has been previously described. The pressure will be maintained in these bags somewhere within 50 to 250 p.s.i. and the mold will be maintained in the oven for a period of approximately 30 to 60 minutes until such time as the resin is thoroughly cured. The exact values to be chosen for pressure, temperature and curing time will vary within the ranges given for different resin compositions. In a typical instance a pressure of about 150 p.s.i. has given a good product of proper density. If a curing time nearer to 30 minutes is desired, a higher oven temperature closer to 350° F. is necessary to assure complete polymerization. This will also produce a shorter time to reach the tacky stage. Typical values used are 325° F., curing thoroughly in 35 minutes, pressure being applied after five minutes. Curing temperatures much below 275° do not give a thorough cure. At temperatures above 350° F. the resin does not heat through properly and will cure unevenly setting up internal stress.

Following the curing of the resin, the mold can be removed from the heat source and the air pressure exhausted from the bags 44 and 68. The top plates 13 and 20 of the mold are removed and the molded racket is extracted from the lower portion of the mold. The pressure bag 44 will still be inside the handle as the racket is removed from the mold and after the connector 50 is extracted from the bracket 46, the pressure bag 44 may be withdrawn from the interior of the handle. The shim 64 is divided at 65 so that it may be collapsed slightly to remove it from the interior of the head and so as to withdraw the pins 66 from the depressions formed thereby. The open end of the handle can then be filled with a plug (not shown) of any suitable type sufficient to seal off the interior of the handle, and such a plug may be either of wood or plastic. The racket then remains only to be finished by completing the drilling of the holes in the head for stringing the racket and the application of a suitable wrapping around the octagonal grip portion of the handle to provide a hand grip.

DESCRIPTION OF THE SECOND EMBODIMENT

Figure 12:
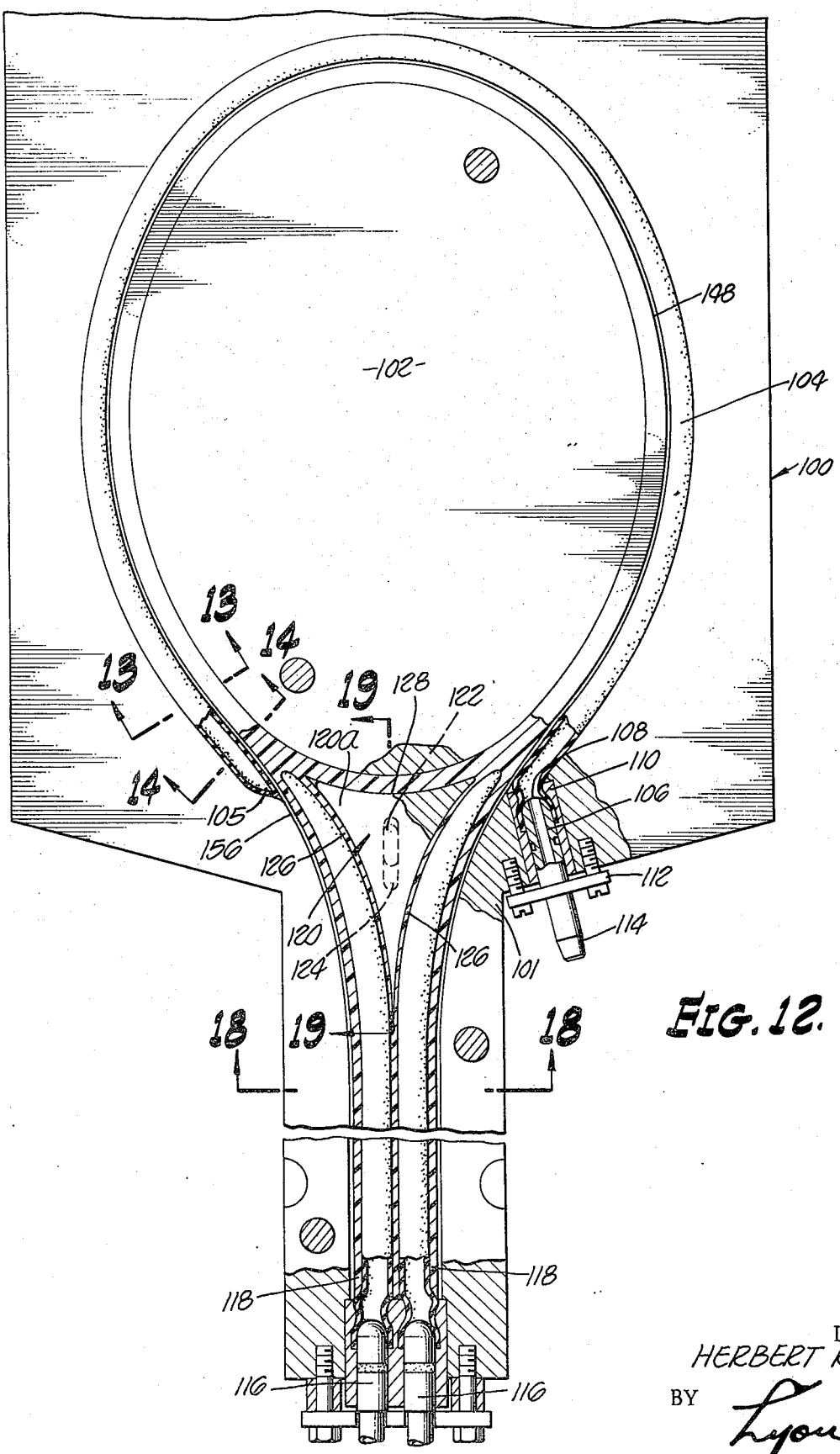

The second embodiment of the invention is disclosed in FIGS. 12 through 30 of the drawings. In FIG. 12, there is shown a plan view of the molding apparatus which is quite similar to that shown in FIG. 1. The changes in the molding apparatus are occasioned by changes made in the second embodiment, particularly that the racket head is molded by applying pressure on the outside of the frame, the handle is not cylindrical but rectangular containing two hollow channels, and the throat of the racket is open. The common feature resides in the continuous strips of unidirectional fiber and the manner in which they are oriented around the racket, and the pretensioned condition which pulls the fibers straight for maximum load-bearing capability.

The base of the mold is indicated at 100 and has an elliptical center plate 102 mounted thereon. The base plate 100 includes side pieces 101 mounted thereto which define the exterior configurations for the finished racket, conforming to the actual exterior of the racket along the handle portion. In the head portion, however, space is provided for the insertion of an expansible pressure bag 104 around the outside of the racket head frame, rather than inside as before. Pressure bag 104 extends from the throat portion all the way around the head frame and is terminated at its extreme end 105 where the end is closed off. The other end is connected to a connector 106 of a type similar to that previously described in connection with the first embodiment, and including a hemispherical end 108 surrounded by a radiused collar portion 110 which is secured in the base plate 100. The cylindrically formed connector 106 is retained in the base plate 100 by bracket 112 and provides a projecting nipple 114 to which a source of air pressure may be connected. In the handle portion, a pair of connectors 116 are provided having a similar configuration and to these two connectors 116 are affixed two longitudinal pressure bags 118 the opposite ends of which are sealed. The bags 118 and 104 are composed of an elastomeric material as previously mentioned and are readily expansible upon application of internal pressure. A cover plate 170 is adapted to be secured to the base plate 100 by any conventional means after all of the laminae and the pressure means are in place.

An additional portion of the mold consists of the throat block 120 which forms an open throat section, providing diverging arms 190, joined by a web section 144. (See FIG. 16). A stud 122 is mounted to the base plate 100 and the block 120 has a longitudinal slot 124 in the lower half in which the stud is received. FIGS. 19 through 22 show the details of this throat forming block. The sides 126 of the block are curved in the horizontal plane in order to form the outwardly curving edges of the split portion of the handle. Likewise, the web edge 128 of the block is curved to conform with the overall elliptical shape of the head frame. Referring to FIG. 20 it will be noted that the sides 126 are also curved in the vertical plane so that the finished inner surfaces of the arms 190 be slightly curved. Similarly, FIG. 19 shows that the surface 128 and the tip 129 are curved in the vertical plane. Block 120 is composed of an upper half **120*a* and a lower half 120*b*, the lower half 120*b* being provided with the longitudinal locating slot 124 and has locating pins 125 which are received in apertures 127 formed in the upper half of the block so that when the halves are placed together their edges will be flush. By forming block 120 in two halves, it can be easily removed from the throat after the racket is molded. If the block were not separable, the curvature formed on the insides of the arms would prevent the extraction of the block from the open throat. The reason for the longitudinal locater slot 124** formed in the block will be more readily apparent when subsequently described in conjunction with the steps of the laminating and curing procedures.

As previously mentioned in discussing the first embodiment of this invention, the materials used are strips of fabric, the fibers being glass, quartz, boron or the like, or various mixtures thereof. The fabric (herein frequently referred to generically is "fiberglass") is pre-impregnated with a thermosetting resin such as epoxy or phenolic and partially cured to the "B" stage, and prior to lay-up is cut into strips of various sizes, some of which are prefolded into various configurations. Some of the fabric is unidirectional and some bidirectional. Unidirectional fabric consists of a plurality of fibers almost all of which are aligned in the same direction with a small number of transverse fibers to hold the others together. Bidirectional fabric has an approximately equal number of fibers in the warp and the woof.

Figure 23:
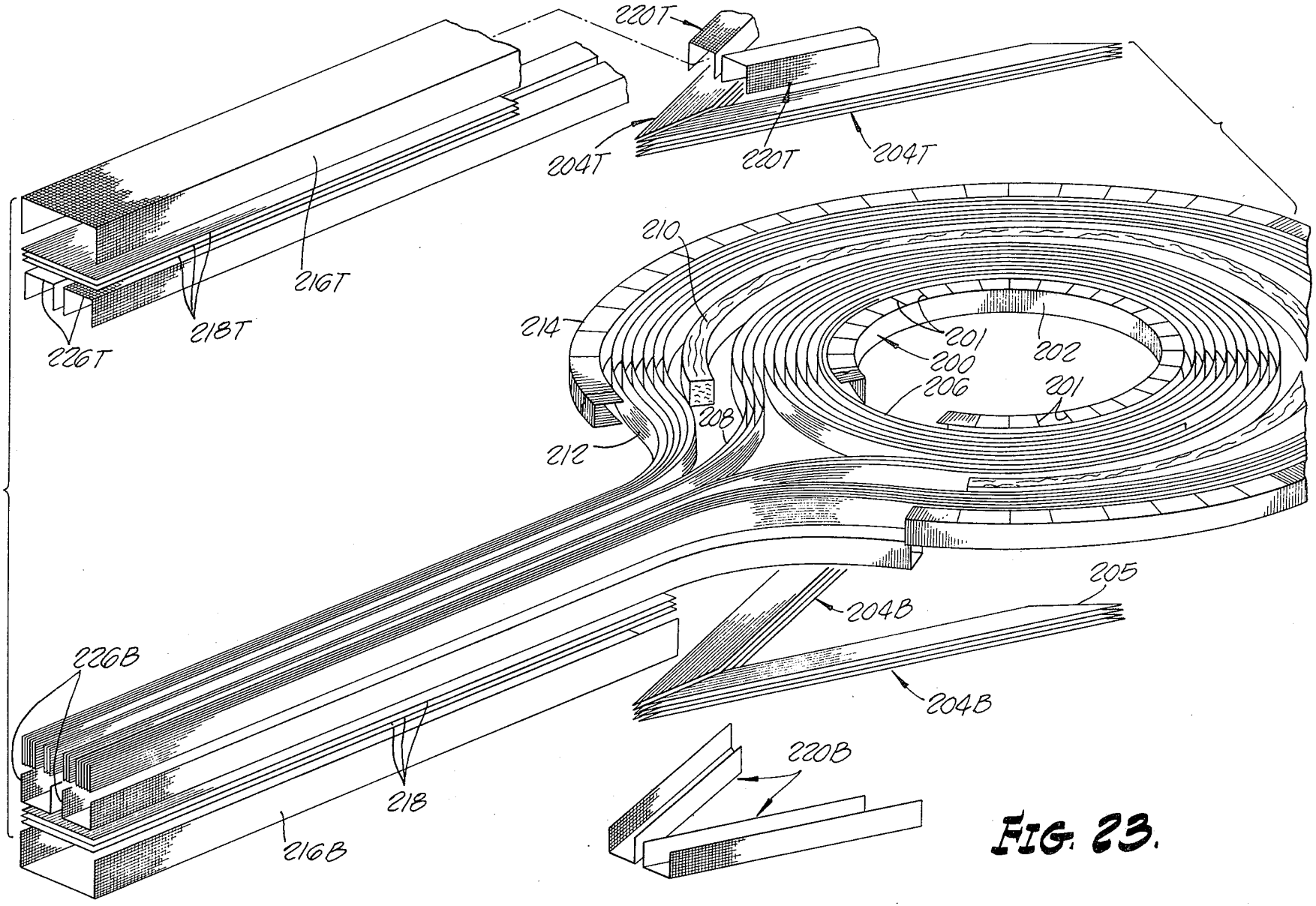
Figure 24:
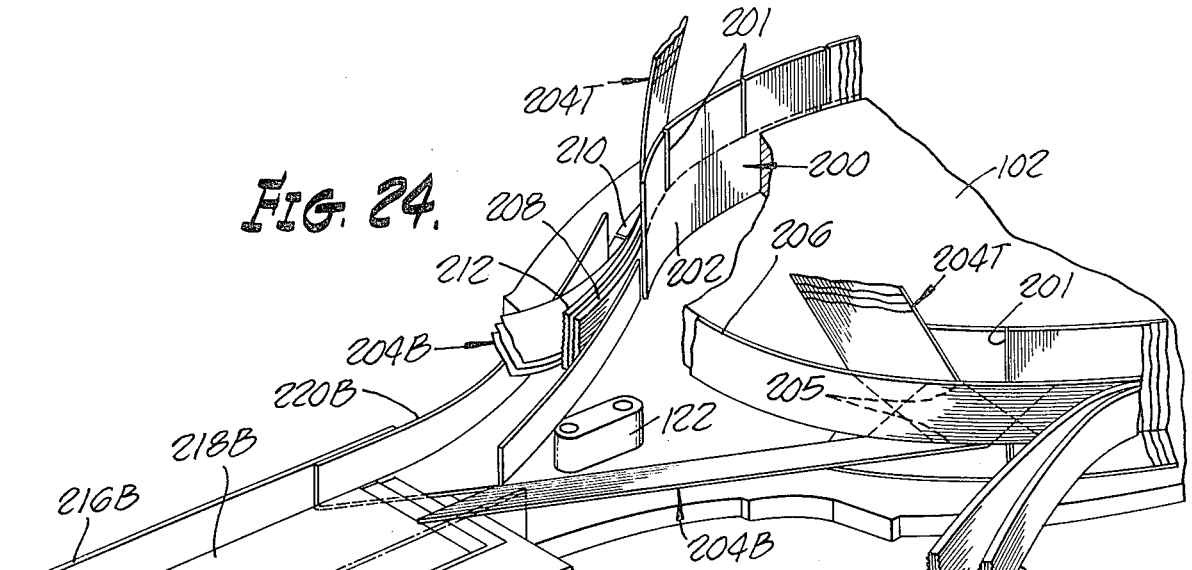
Figure 25:
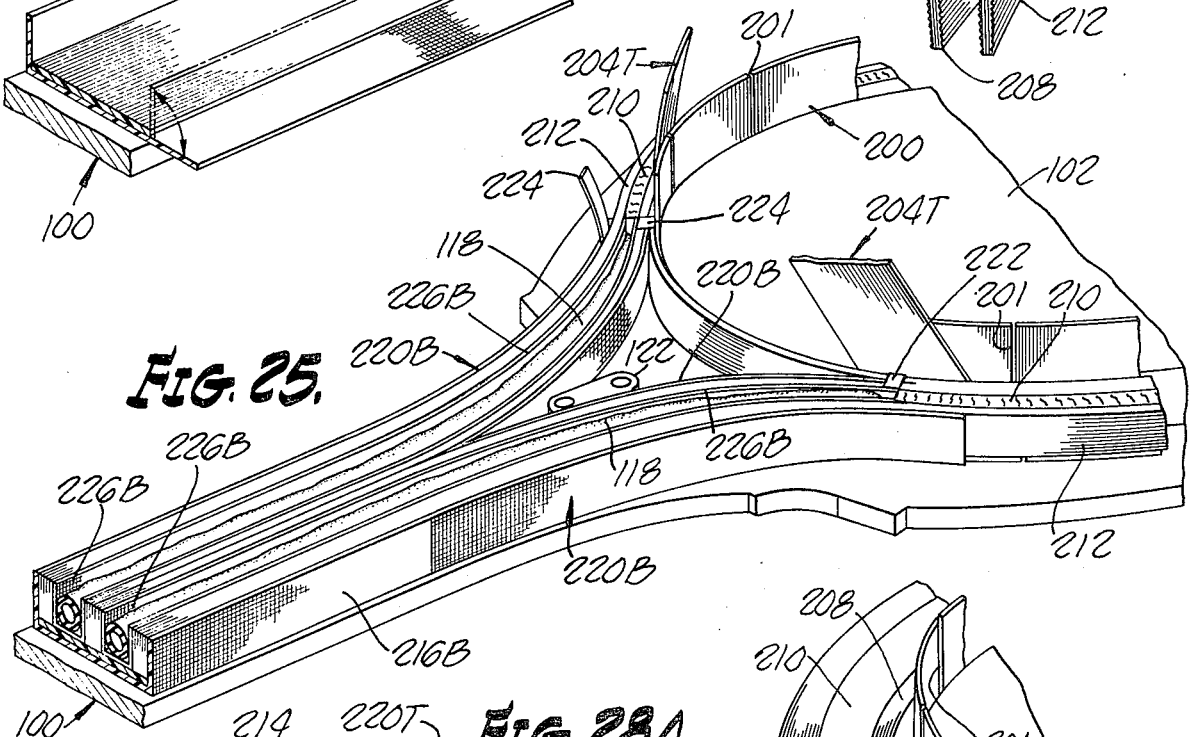
Figure 26:
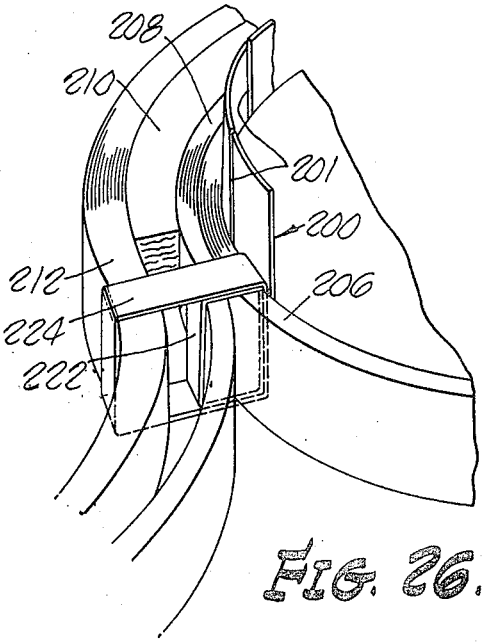
Figure 27:
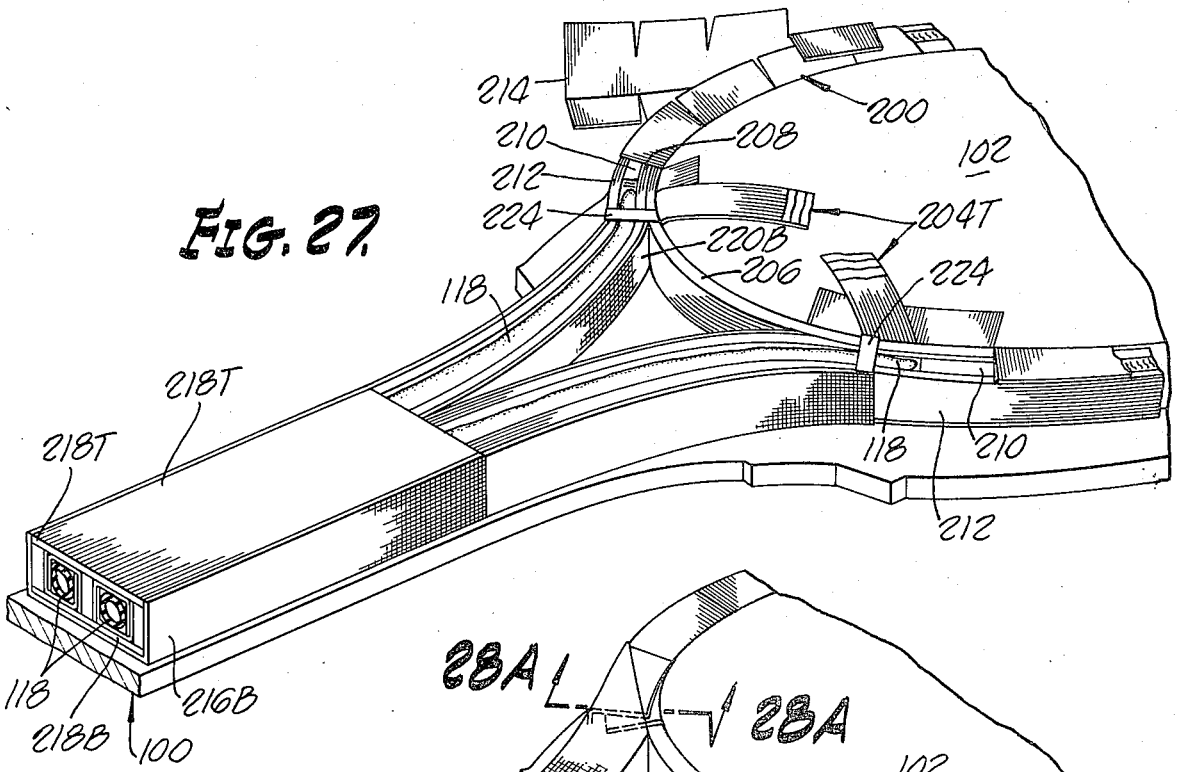
Figure 28:
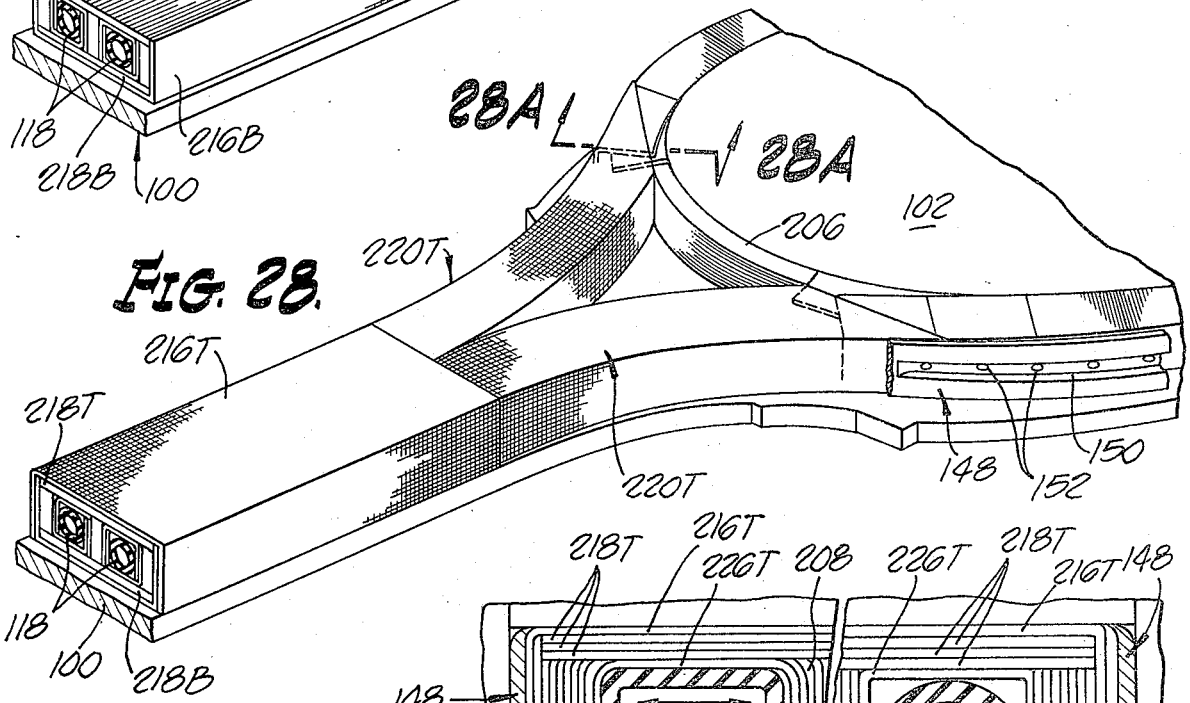

The following description of the lay-up procedure affords a basis for clearly explaining the disposition of the various layers of fabric in the racket and the relative contributions of each, it being understood that the precise sequence of steps in the lay-up procedure is by no means restricted by this description. The first steps involve the assembly of the various strips of material which make up the headframe. Although the drawings show an assembly of the various strips both in the headframe and in the handle with those related portions of the mold partially assembled, it has been found to be easier to preassemble portions of the headframe by separating the center plate 102 from the base plate 100, mounting the center plate on a suitable jig whereby it might be rotated about an axis through the center of the plate to facilitate the wrapping of various strips thereabout. The first material forming the racket comprises prefolded inner channel members 200 consisting of one or two plies and composed of unidirectional fabric, the fibers of which are oriented transversly of the length of the members. Channel members 200 have a plurality of cuts 201 at intervals along the length thereof and the base 202 of the channels is positioned against the edge of center plate 102. The segmental cuts 201 permit the channel to be curved in the manner shown in FIG. 23. In FIGS. 24, 25, and 26, the upper sidewalls of inner channel members 200 are shown in an upwardly extending position only for clarity of illustration. Channels 200 do not extend all the way around the center plate 102 but, as shown in FIG. 24, the ends of the channels terminate at the points at which the two arms of the throat of the racket join the headframe.

Next, a number of throat arm strips 204B and 204T are added. These are short strips of material having an initial configuration somewhat as shown in FIG. 23, with the ends thereof cut at angles to the longitudinal dimension. Strips 204 (T and B) are composed of unidirectional fabric, the fibers of which are oriented longitudinally. Strips 204T and 204B will ultimately form a portion of the top and bottom skins respectively of the throat arms 190. They are placed with the ends thereof flat against the inner bottom surface 202 of channel members 200, with the angular end portions 205 oriented as shown in FIG. 24, that portion of strips 204 not in contact with the base of channels 200 are bent at approximately 90° angles and oriented substantially as shown. These arm strips preferably are four plies in number, both for the top and bottom portions.

Next after inserting the ends of the arm strips 204 and bending them so as to clear the sidewalls of the channels 200, a long continuous wrapper 206 is wound about the center plate 102 and positioned in the channel members 200 covering the ends 205 of arm strips 204. Wrapper strip 206 is composed unidirectional fabric, the fibers of which are oriented longitudinally, and this strip comprises approximately seven plies accomplished by wrapping it around the center plate seven times.

After wrapper strip 206 is in place, the next pieces added are a first plurality of long continuous strips 208, composed of unidirectional fabric the fibers of which are oriented longitudinally. Strips 208 are of sufficient length to extend from the butt end of the handle, all the way around the headframe and back down to the butt end of the handle again. Strips 208 are, like the others, positioned within the channel member 200. A strip of balsa wood 210 is then inserted adjacent strips 208. Balsa strip 210 is of substantially rectangular cross section and the grain thereof is oriented laterally of the cross section, or in other words when strip 210 is wrapped around the headframe, the grain of the balsa wood will be disposed substantially radially with respect to the headframe. By so orienting the grain of the balsa wood and by utilizing wood of low density, this strip provides only filler and spacer material for the headframe keeping the weight of the head down while obtaining the necessary dimensions for the cross section of the headframe. The orientation of the grain provides rigidity primarily in only the lateral dimension to support the position of the fiber materials on each side thereof so that those fibers perform their necessary functions during use of the product. Thus, the wood strip is not itself a functional element, taking no significant part in the performance of the racket except as it provides dimensional integrity to the other related parts. After insertion of the wood strip, a second group of longitudinal strips 212 are added, of the same type as the first strips, being of the same length and composed of unidirectional fibers. In FIG. 23, it is shown that there are three strips 208 disposed about the headframe inside of the wood strip and six strips 212 on the outside of the wood strip. Throughout the description of the various lamina in the present invention, the number of plies of material will be mentioned by way of example, it being contemplated that the number of plies, principally those portions employing unidirectional material may be varied to achieve different weights and balances for the racket and to vary the rigidity and torque characteristics thereof.

After the second group of strips 212 have been layed in the inner channel members 200, outer channel members 214 are placed about the combined assembly. The outer channels 214 are also composed of unidirectional fabric, the fiber orientation being transverse with respect to the longitudinal dimension of the channel so that after molding, these fibers join with those of channels 200 to form a shell around strips 208, 210, and 212, the fibers of which are disposed radially. Channels 214 have the sidewalls thereof cut at spaced intervals to permit bending about the headframe.

After the aforesaid elements of the head of the racket have been assembled, the combination attached or wound about the center plate 102 is returned to the mold for the assembly of the remaining portions of the racket. In the handle portion of the racket, there is first layed an outside channel member 216B which will ultimately provide the bottom outer covering layer for the handle. This channel member 216B is composed of bidirectional fabric. Next, inside of channel 216B, is provided a number of sheets 218B the lateral dimension of which corresponds to the overall width of the handle. These sheets 218B are composed of unidirectional fabric and extend substantially from the butt end of the handle to the point where the handle splits into two throat arms 190. In the throat portion, a pair of bottom arm channel members 220B is placed with one end abutting or adjacent the outside channel member 216B of the handle and the outer ends extending to join at the sides of the headframe. FIG. 24 shows the position of one of the arm channels 220B in relationship to the other parts of the lay-up. The arm channels 220B are likewise composed of bidirectional fabric and will compose part of the outer skin for throat arms 190.

After the arm channels are in position, and the center plate 102 with the previously assembled materials is placed generally in the position shown in FIG. 24, the bottom arm strips 204B are then aligned along the bottom of the bottom arm channels 220B. Then, the long strips 208 and 212 coming from around the center plate are positioned along the inside of the arm channels with the flat dimension thereof oriented vertically. At the point where the long strips 208 separate from the wrapper strip 206, a first binder strap 222 is wrapped around the wrapper strip 206 and strips 208 to securely tie those strips together at the point of divergence. Next, a second binder strap 224 is added at the same point of divergence and wraps around the inside of wrapper strip 206, then around both long strips 208 and 212, binding them all securely together at this point. The binder straps 222 and 224 do not encompass the arm strips 204, nor the arm channels 220. See FIG. 26.

Now, in the handle portion of the racket, above the wide bottom strips 218B are positioned a bottom pair of inner channel members 226B with their open side facing upwardly and extending from the butt end of the handle up past the divergent point of the throat section to approximately the point of termination of the wood strip 210, in the vicinity of the binder straps 222, 224. The long strips 208 and 212 coming from around the center plate are stationed outside of the inner channel members 226B, strips 208 being positioned between the sidewalls of adjacent channels 226B and the strips 212 being stationed between the outer walls of the channels 226B and the inner wall of the large channel member 216B. A pair of expansible pressure tubes 118 are then layed into the open channels 226B extending from the butt end of the handle up to the wood strip 210.

Next, a top pair of inner channel members 226T are inserted with the open sides facing downwardly over the bottom channel members 226B so that the sides are adjacent one another in overlapping relationship, thus enclosing the expansible tube members 118. The large binder strap 224 is fastened around the combination thus far assembled including the upper and lower channel members 226. Then, the upper arm strips 204T are bent or folded downwardly and aligned in the arm channels 220B laying their flat dimension adjacent the base portion of the upper channel members 226T. A second group of large flat sheets 218T are oriented in the handle portion similar to the bottom sheets 218B extending substantially the entire length of the handle up to the point of divergence of the throat. Finally, an outer channel member 216T is inserted on top, covering the entire handle assembly. As before, channel 216T is of bidirectional fabric.

In the throat portion, top arm channels 220T are inserted covering the assembly of strips in that portion of the structure, and these arm channels are likewise of bidirectional fabric. A long metal strip 148 comprising a shim is placed outside all of the strips next to the inner edges of the mold. In the headframe portion of the racket, the shim has the inner configuration shown in FIG. 15 wherein the inner edges 149 are partially radiused. See FIGS. 13, 14 and 29. This surface radiuses the edges of the finished racket. The portion of shim 148 which extends around the headframe also has a longitudinal embossment 150 along the inner surface and a plurality of protuberances 152 are posed at spaced intervals. Embossment 150 forms a long depression 154 (FIG. 16) around the headframe so that when the racket is strung, the strings will not extend past the edges of the racket. The protuberances 152 form depressions 156 in the base of the depression 154 to locate the position of the racket stringing holes 158 which will be later drilled as indicated in FIG. 17. Shim 148 also functions during the molding process to aid in the stretching of the fabric, as will be explained subsequently.

The headframe pressure bag 104 is now placed in the mold between the mold sides 101 and shim 148. Pressure bag 104 is connected to pressure connector 106 as previously described. Also, as previously described the longitudinal pressure tubes 118 are connected to their respective pressure manifold 116. The throat block 120 is inserted to form the separation between the divergent arm sections and then a cover plate 172 is provided closing the top of the mold and holding all of the lamina inside. To permit adjustment for thickness, spacing shims 174 and 176 may be provided in the interior of the mold as shown in FIGS. 13 and 14.

After the mold is closed, it is placed in a heated oven or the like maintained at the temperatures previously mentioned. After heat has been applied for a time sufficient to permit the resin to become soft and somewhat fluid (usually about two minutes) the headframe pressure bag 104 is pressurized. The expansion of bag 104 forces the fibers of the various lamina surrounding the center plate 102 into a close compacting relationship. More important however, while the resin is in the fluid state the fibers are mobile and capable of migrating. The configuration of the pressure bag 104 around the center plate 102 leaves only one area of pressure relief in the vicinity of the throat section of the racket. Thus, the expansion pressure of bag 104 causes the mobile fibers to migrate toward the handle section pulling them tautly around the center plate. This assures not only that the headframe is molded in the highest possible density but the migration of the fibers around the center plate and places them in a slight degree of tension assuring that all of the fibers are straight and therefore equally capable of bearing a load. In the pressurized condition, bag 104 will assume the approximate configuration shown in FIGS. 13 and 14. The pressure in bag 104 is released after a short period and then pressure is applied in the handle bags 118 for a short period. This pushes the various fibers in the handle and throat sections into place. Pressure is then released in bag 118 and the resin is allowed to polymerize until it reaches the tacky state. At that point, full pressure is applied to bags 104 and 118 and heat and pressure are maintained until the resin is fully cured.

Figure 29:
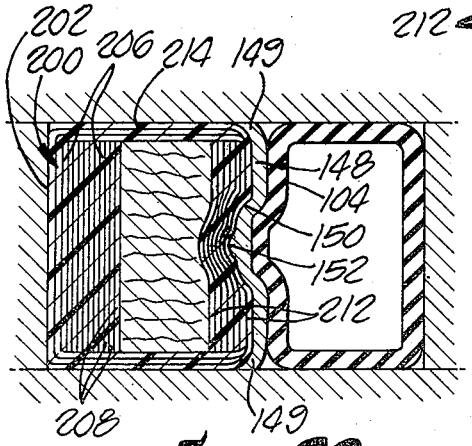

When pressure is applied, it causes the shim 148 to press against the outer edges of the racket and the curved edges 149 radius the outer edges of the racket as previously mentioned. At the same time, as shown in FIG. 29, which is a cross-sectional view taken in the headframe portion of the racket, it will be seen how the longitudinal embossment 150 and the small protuberances 152 force the fibers of the lamina inwardly to form the groove 154 and the starter holes 156. In addition to forming those features, the embossment 150 has an additional function. It will be recalled that the channel portions 200 and 214 form a shell of fabric the fibers of which are oriented transversely with respect to their major dimension so that the fibers are oriented generally radially about the headframe. Once the resin has reached the tacky stage, and pressure has been applied for the final stage of curing the inward pressure exerted upon the combination by the embossment 150 increases the peripheral surface dimension of the cross section so that the fibers of channel sections 200 and 214 tend to be pulled apart. But, because pressure is applied after the resin has become tacky, the fibers adhere together so that the inward thrust of the embossment 150 along the outer periphery of the headframe tends to pull the fibers of channels 200 and 214 apart thereby placing them under tension. This resultant stressing of this shell around the headframe of the racket occurs at the same time that the previously described molding steps are undertaken, particularly the initial pressurization of the pressure bag 104 around the headframe followed by the pressurization of the longitudinal pressure tubes 118. This sequential pressuring causes the migrating fibers to first move downwardly toward the throat portion of the racket thereby pulling the longitudinal fibers which extend around the headframe downwardly towards the throat thereby straightening all of the unidirectional fibers and placing them under tension, while at the same time, the transverse fibers of the shell are also tensioned.

Figure 28A:
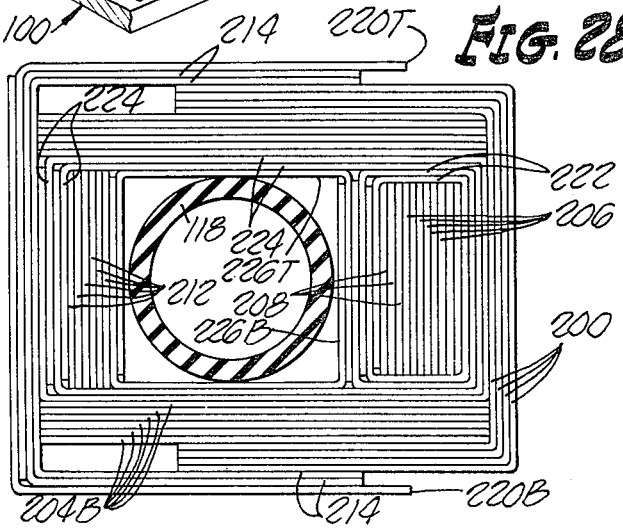
FIG. 28A is a sectional elevation taken along line 28A—28A of FIG. 28 showing the disposition of the layers of fabric at the point where the throat joins the head frame.

In the handle, the outwardly diverging sides 126 of the throat block 120 permit the outwardly curved ends of the pressure bags 118 to push the block upwardly toward the headframe. In this manner, the block will exert a compressive force against the web 144 of the headframe, thus assuring a high density molding in that area. The fact that the slot 124 in the block 120 is elongated permits the block to move upwardly as described. The sequential pressurization of the composite structure inside the mold, and the upward movement of the throat block tends to cause longitudinal tension to be exerted upon all of the strips in the handle and arm sections and the slight degree of tension upon those longitudinal unidirectional fibers assures that a substantial majority of those fibers will be straight thereby assuring that most if not all of the fibers will be capable of carrying load when the racket is in use. The internal application of pressure by the ends of bags 118 in the area represented by the cross section of FIG. 28*a* further contributes to the tensioning of the fibers in a manner similar to that occuring in the handle portion of the racket itself and for that, reference may be had to FIG. 30.

Figure 30:
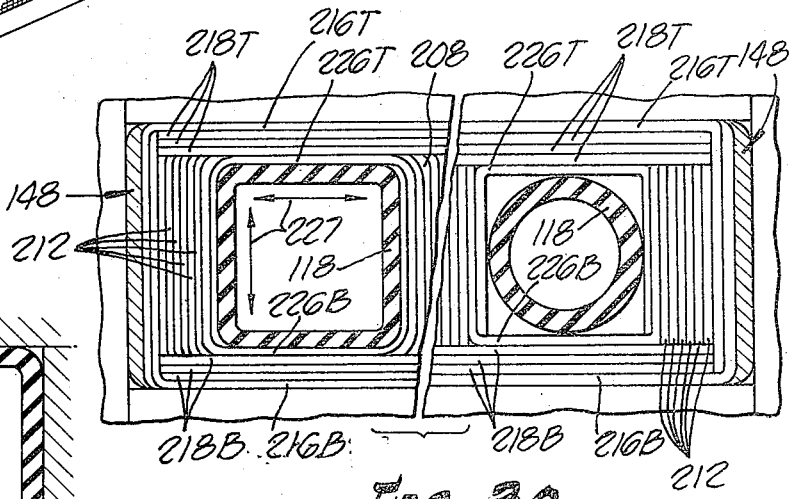

In FIG. 30, which is an enlarged cross-sectional view of the handle portion of the racket, the right hand side of the figure shows the various lamina in the handle prior to polymerization and prior to the application of pressure inside the expansible pressure tube 118. In the right hand side of FIG. 30, it will be seen that immediately surrounding expansible tube 118 are the inner top and bottom channel members 226. Turning to the left hand side of FIG. 30, there is shown the somewhat altered positions of the fibers after polymerization of the resin, this different configuration being the result of the migration of the fibers while the resin is in a fluid state, augmented by the internal expansion of the pressure tube 118 as indicated by the arrows 227, which causes adherance and tensioning of the inner fibers. Curved fillets will be seen to have been formed where the center vertical rib 182 and the side ribs 183 join the upper and lower skins 184 and 185 of the handle. (See also FIG. 18). These fillets are the result of migration of the longitudinal fibers in the upper and lower skins and in the strips 208 and 212 when the bags 118 expand, since there are very few transverse fibers in these strips. Fillets formed between the ribs and the upper and lower skins, thus contribute to the formation of an outer shell for the handle and throat portions having considerable rigidity.

After the resin is cured, and the mold has been removed from the source of heat, the pressure can be exhausted from the expansible pressure means. After the racket has cooled for a short time, the pressure bags can be slid out of the hollow channels formed in the handle and the throat block can be disassembled and removed. At this point, a racket blank is provided generally as shown in FIG. 16 and the stringing holes can then be drilled using the starter depressions 156. The configuration of the handle portion of the racket as shown in FIG. 16 is substantially rectangular having two longitudinal hollow rectangular cavities 188. It is apparent from the sectional view shown in FIG. 12 that these cavities are hollow up past the throat portion to where the arms in the throat portion join the headframe. The racket may then be finished by securing trapezoidal elements 196 to the rectangular portion of the handle both on the top and bottom so that the customary octagonal grip is provided. These grips may be bonded to the handle or applied with wrapping as desired.

DESCRIPTION OF THE THIRD EMBODIMENT

FIGS. 31 – 35 set forth a third or alternate embodiment of the present invention providing a racket which is somewhat less expensive to manufacture than those set forth in the previously described embodiments. In this embodiment, the handle of the racket is layed up and constructed substantially in the same manner as for the second embodiment, the differences herein residing in the manner in which the headframe of the racket is constructed and an additional variation in the construction of the throat of the racket. In this embodiment, the drawings do not depict the actual number of layers of fabric as that will vary depending upon the action and strength one desires to accomplish. The configuration of the throat arms 302 will be substantially similar to that shown in the second embodiment, and the entire throat may be constructed as shown in the second embodiment using the sliding throat block 120 and producing a racket having the web section 144. The ensuing description will include the alternate configuration of the throat, which can be used in either of the embodiments as well.

Figure 31:
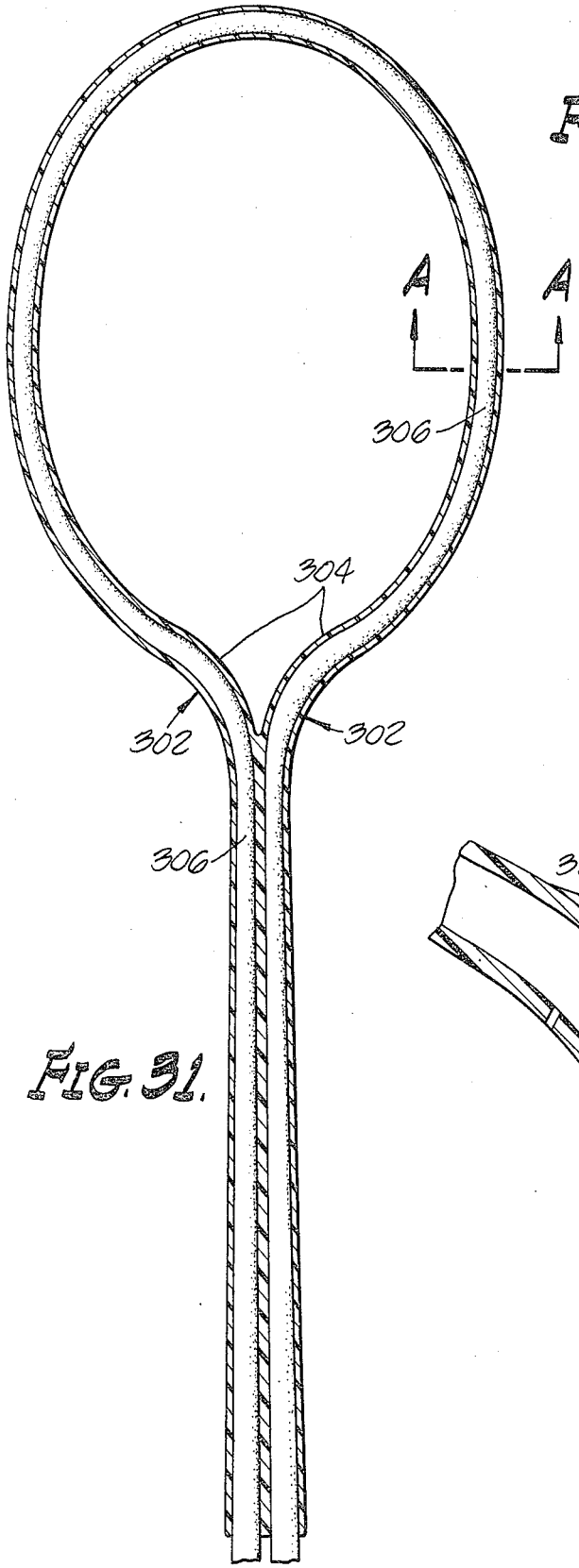
FIGS. 31–35 show features of the third embodiment of this invention.
Figure 32:
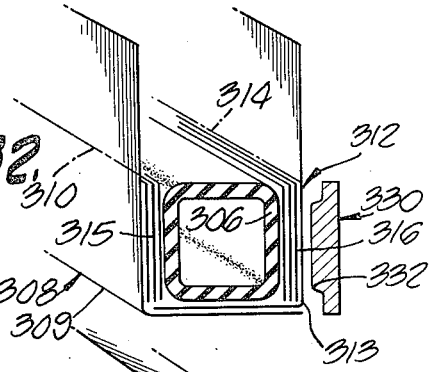
Figure 33:
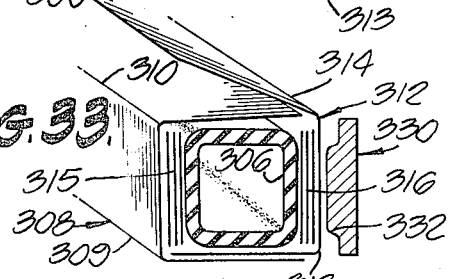
Figure 34:
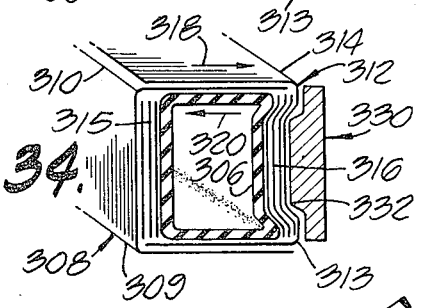

The lay-up of the headframe commences approximately at points 304 on the throat arms 302. The cross sectional views in FIGS. 32, 33 and 34 are taken along line A—A of FIG. 31 and demonstrate certain stages of the assembly procedure. The principal difference in the present embodiment is that the pressure bag 306 is a continuous tube extending all the way from the butt end of the handle around the headframe and back down again. In the alternative, it is contemplated that this pressure bag 306 may extend up each side of the racket and headframe and comprise two separate bags the ends of which abutt near the top of the headframe. In either instance, the resulting construction, as shown in FIG. 31 is a continuous substantially rectangular hollow tube.

The lay-up of the headframe comprises inner channel members 308 composed of unidirectional fabric, the fibers of which are oriented transversely of the length thereof. Channel members 308 are folded at 309 and 310. FIG. 32 shows the upper portion initially unfolded along line 310 to permit insertion of the interior layers of fabric. Likewise, an outer channel member 312 is provided having folds at 313 and 314. Channels 308 and 312 are positioned so that their bottom layers overlap in the manner shown in FIG. 32. Inside of channels 308 and 312 are positioned a plurality of long continuous strips 314 and 316 stationed along the sidewalls of the channels. In the interior of the channels between the strips 314 and 316 is positioned the expansible pressure tube 306. The exterior shim previously utilized is no longer necessary to provide the groove for the strings, there being no expansible bag immediately adjacent the fabric. Instead, the mold itself, shown in part at 330, is provided with embossment 332.

As shown in FIG. 33, after the previously mentioned layers of fabric are placed inside the channel members, and the pressure tube is in place, channels 308 and 312 are folded along lines 310 and 314 respectively so that the sidewalls thereof are in overlapping relationship as are the lower sidewalls. When the assembly is placed in the mold and pressure and heat are applied in the manner previously described, pressure tubes 306 will expand, forcing the one wall of channel 312 against the embossment 332 to deform the sidewall and the strips 316 in the manner shown in FIG. 34. As previously described, when the resin has become tacky, the sidewalls of channels 308 and 312 will adhere together and the defomation caused by the embossment 332 will pull upon the fibers of the adjacent sidewalls in the directions shown by arrows 318 and 320, thereby straightening them so that they will perform their maximum load carrying capability.

As previously described, the expansion of the pressure tube 306 will form fillets in the inside corners of the headframe. Tensioning forces are also exerted upon the vertically disposed layers 314 and 316 so that those fibers will be straight and strong.

Figure 35:
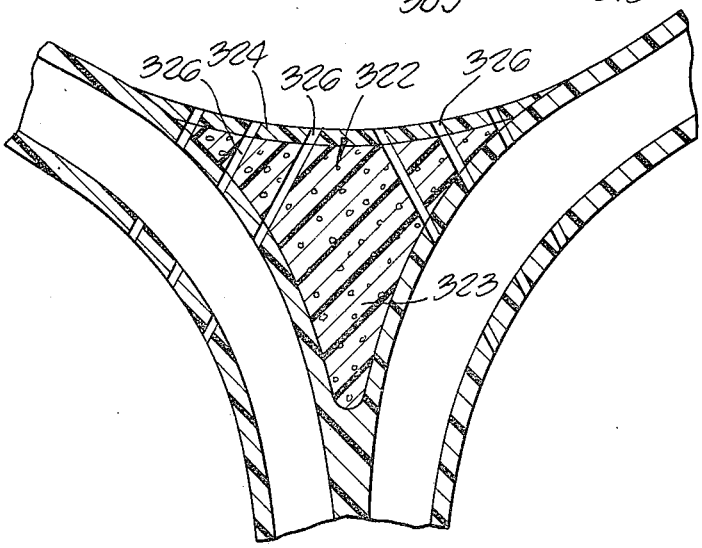

As an optional variation, the finished racket will have a divergent throat portion without any connecting web of the type shown in the second embodiment. To provide a section to facilitate stringing the racket and somewhat to enhance the rigidity thereof, a throat block 322 is provided consisting of a somewhat triangularly shaped piece of foam material 323 along the exposed surface of which is adhered a strip of fiberglass 324. This composite block may be cemented in place as shown in FIG. 35. After completion of this step, the racket stringing holes 326 may be drilled through the block and through the throat arms 302.

While several embodiments of the present invention have been shown and described herein, it will be obvious that other changes and modifications might be made without departing from the invention in its broader aspects. Common to the various embodiments is the utilization of internal or peripheral pressure in the headframe to produce tensioning of the fibers to provide a densely molded structure of high strength. In addition, the arrangement of the various laminae, particularly in the throat section, provides the ability to produce a finished racket having desirable strength and flexibility and variations in the number and orientation of such laminae is contemplated for that purpose. It is intended that the invention and its modifications be defined by the lawful scope of the appended claims.

I claim:

1. A tennis racket or the like composed of fibers and resin molded into an integral structure have a head frame portion, a handle portion, and a throat portion:

said handle portion comprising an outer shell having a rectangular cross section and further comprising an upper skin, a lower skin, a pair of outer ribs and a central rib, said ribs extending perpendicularly between said skins in laterally spaced-apart positions, said upper and lower skins bridging said outer ribs, said central rib dividing the interior of said handle into a pair of hollow rectangular longitudinal core members, said central rib comprising an integral common wall of said core members;

said hollow rectangular core members being separated at the end of said handle portion by division along the central axis of said central rib to form said throat portion having divergent arm members, said separated core members thus having upper and lower skins and spaced side ribs, a web section situated between the spaced-apart arm members of said throat portion, said web section being integrally joined to the innermost side ribs of said core members;

said core members extending through said divergent throat section and then joining together in an annular bow to form said head frame, the annulus being completed in the throat portion by said web section;

said rectangular core members comprising a plurality of unidirectional fibers the significant majority of which are oriented in planes parallel to the hitting plane of the racket, said unidirectional fibers being surrounded by fibers forming part of said outer shell wherein said last named fibers are not oriented parallel to the hitting plane;

the core members in said throat and head frame portions comprising rib members consisting essentially of longitudinally oriented unidirectional fibers, the upper and lower skins thereof having multidirectionally oriented fibers;

substantially all of the aforesaid fibers being under tension.

2. The combination set forth in claim 1 wherein the core members in said throat and head frame portions of said racket comprise rib members consisting essentially of unidirectional fibers, the upper and lower skins of said core members having multidirectionally oriented fibers, the quantity of the fibers in said ribs substantially exceeding the quantity of fibers in said upper and lower skins.

3. The combination set forth in claim 1 further including a relatively small additional quantity of unidirectional fibers disposed within the upper and lower skins of said handle portion, said additional portion of unidirectional fibers extending from the butt end of said handle to the commencement of the throat portion of said racket.

4. The combination set forth in claim 1 wherein:

a first portion of said unidirectional fibers extend continuously about only said head frame integrally forming said web section and a portion of the innermost rib in said head frame portion;

a second portion of said unidirectional fibers extending continuously through said ribs and having the ends thereof at the butt end of said handle portion.

5. The combination set forth in claim 4 further including a third portion of unidirectional fibers situated in said ribs, said third portion of fibers extending through said throat portion, some of the ends thereof terminating in the handle portion intermediate the ends thereof, and the other ends terminating in the head frame portion.

* * * * *